US006103211A

United States Patent [19]

Matsuhisa et al.

[11] Patent Number: 6,103,211

[45] Date of Patent: Aug. 15, 2000

[54] CARBON FIBERS, ACRYLIC FIBERS, AND PRODUCTION PROCESSES THEREOF

[75] Inventors: Yoji Matsuhisa; Makoto Kibayashi; Katsumi Yamasaki; Akira Okuda, all of Ehime, Japan

[73] Assignee: Toray Industries, Inc., Japan

[21] Appl. No.: 08/983,393

[22] PCT Filed: May 22, 1997

[86] PCT No.: PCT/JP97/01716

§ 371 Date: Jan. 20, 1998

§ 102(e) Date: Jan. 20, 1998

[87] PCT Pub. No.: WO97/45576

PCT Pub. Date: Dec. 4, 1997

[30] Foreign Application Priority Data

May 24, 1996 [JP] Japan ..... 8-129649

[51] Int. Cl.[7] ..... D01F 6/00

[52] U.S. Cl. ..... 423/447.8; 423/447.1

[58] Field of Search ..... 423/447.2, 447.8, 423/447.1; 264/29.2, 29.7

[56] References Cited

U.S. PATENT DOCUMENTS 5,209,975 5/1993 Miyazaki et al. ..... 428/364

5,348,802 9/1994 Matsuhisa et al. ..... 428/367

*Primary Examiner*—Steven P. Griffin

*Assistant Examiner*—Stuart L. Hendrickson

*Attorney, Agent, or Firm*—Austin R. Miller

[57] ABSTRACT

The object of the present invention is to provide carbon fibers with high tensile strength as a resin impregnated strand even if the single filaments constituting the carbon fibers are thick. The carbon fibers of the present invention consisting of a plurality of single filaments are characterized by satisfying the following relation:

$$\sigma \geqq 11.1 - 0.75d$$

where σ is the tensile strength of the carbon fibers as a resin impregnated strand (in GPa) and d is the average diameter of the single filaments (in μm). The carbon fibers can be preferably used as a material for forming energy-related apparatuses such as CNG tanks, fly wheels, wind mills and turbine blades, a material for reinforcing structural members of roads, bridge piers, etc., and also a material for forming or reinforcing architectural members such as timber and curtain walls.

2 Claims, No Drawings

CARBON FIBERS, ACRYLIC FIBERS, AND PRODUCTION PROCESSES THEREOF

This application is a 371 U.S. national stage application of PCT/JP97/01716 filed May 22, 1997.

TECHNICAL FIELD

The present invention relates to carbon fibers, acrylic fibers (precursor fibers) preferably used for producing the carbon fibers, and production processes thereof. In more detail, the present invention relates to carbon fibers satisfying specific relations not satisfied by the conventionally known carbon fibers, expressed as tensile strength of a resin impregnated strand of the carbon fibers, and as the average diameter of single filaments constituting the carbon fibers, and also as acrylic fibers (precursor fibers) preferably used for producing said carbon fibers, and production processes thereof.

BACKGROUND ARTS

Carbon fibers have been applied for sporting goods and aerospace materials because of their excellent specific strength and specific modulus, and are being used in wider ranges in these fields.

On the other hand, carbon fibers are also used for forming energy related apparatuses such as CNG tanks, fly wheels, wind mills and turbine blades, as materials for reinforcing structural members of roads, bridge piers, etc., and also for forming or reinforcing architectural members such as timber and curtain walls.

Since that carbon fibers are being applied in wider fields, they are demanded to have higher tensile strength when expressed as a resin impregnated strand than before, and for further expanding applicable fields, the carbon fibers are demanded to be produced at lower cost.

The conventional techniques for improving tensile strength of carbon fibers as a resin impregnated strand have been concerned with decrease of macro-defects, for example, for decreasing impurities existing inside single filaments constituting the carbon fibers, or for inhibiting the production of macro-voids formed inside the single filaments, and for reducing defects generated on the surfaces of the single filaments.

To decrease the inner impurities and macro-voids of single filaments, techniques to intensify the filtration of monomer or polymer dope are proposed in Japanese Patent Laid-Open (Kokai) No. 59-88924 and Japanese Patent Publication (Kokoku) No. 4-12882. Furthermore, techniques to inhibit the production of surface defects by controlling the shape of fiber guides used in the production process of precursor fibers or controlling the tension of fibers in contact with a guide are proposed in Japanese Patent Publication (Kokoku) No. 3-41561.

Although they were effective in improving strength in the past, when the tensile strength level of carbon fibers as a resin impregnated strand was low, the techniques have already achieved their intended effects of strength improvement, as impurities and macro-voids have been almost perfectly removed. In other words, these techniques cannot be expected to improve the strength further.

Furthermore, when precursor fibers are stabilized and carbonized at a high temperature to produce carbon fibers, coalescence between single filaments is likely to occur, and the coalescence between single filaments and marks that remain after their separation cause surface defects, and lower the fiber strength.

To inhibit coalescence between single filaments, techniques for impregnating precursor fibers with fine particles of graphite in the production process of precursor fibers are proposed in Japanese Patent Laid-Open (Kokai) No. 49-102930 and Japanese Patent Publication (Kokoku) No. 6-37724, and a technique for impregnating precursor fibers with fine particles of potassium permanganate is proposed in Japanese Patent Publication (Kokoku) No. 52-39455.

The addition of these fine particles was effective in improving strength in the past when the coalescence between filaments occurred frequently and the tensile strength of carbon fibers as a resin impregnated strand was at a low level. However, today when the coalescence between filaments has been decreased to improve the strength level due to the application of the above techniques, these hard inorganic fine particles impregnated onto soft swelling fibers during production cause surface defects and lower the tensile strength of the carbon fibers when assembled as a resin impregnated strand.

Furthermore, to inhibit coalescence between single filaments, techniques are proposed to improve process oil as applied to precursor fibers. Techniques for applying silicone oils, which are excellent in lubricity and smoothness, instead of conventional non-silicone oils made from higher alcohols are proposed in Japanese Patent Publication (Kokoku) Nos. 60-18334 and 53-10175 and Japanese Patent Laid-Open (Kokai) Nos. 60-99011 and 58-214517.

Moreover, techniques for improving heat resistance of silicone oils are proposed in Japanese Patent Publication (Kokoku) Nos. 4-33862 and 58-5287, and Japanese Patent Laid-Open (Kokai) No. 60-146076. Particularly epoxy-modified silicone oils are proposed in Japanese Patent Publication (Kokoku) Nos. 4-29766 and 60-18334. The use of a mixture of amino-modified silicone and epoxy-modified silicone is proposed in Japanese Patent Publication (Kokoku) Nos. 4-33892 and 5-83642. The use of a mixture of an amino-modified silicone, epoxy-modified silicone and alkyleneoxide-modified silicone in combination is proposed in Japanese Patent Publication (Kokoku) No. 3-40152. However, even if these oils are applied, the coalescence between single filaments was not perfectly inhibited, in other words effect of inhibiting the coalescence between single filaments was not sufficient.

On the other hand, if these oils are improved in heat resistance, the deposition of oil gels (hereinafter called gum-ups) on the heating rollers, etc. located downstream of the oiling process, increases problems greatly in achieving of stable production. Therefore, the equipment has to be stopped very frequently to remove the gum, or expensive gum removers must be installed which cause increased production cost.

Techniques to remove the surface defects generated in the precursor fiber production process, carbonization process or any subsequent processes are proposed. Techniques for heating carbon fibers in a dense inorganic acid are proposed in Japanese Patent Laid-Open (Kokai) No. 54-59497 and Japanese Patent Publication (Kokoku) No. 52-35796, and a technique for electrolyzing in inorganic acid at high temperature is proposed in Japanese Patent Publication (Kokoku) No. 5-4463. These techniques remove the generated surface defects by etching.

However, these techniques require inserting treatment of surface chemical functions excessively produced as a result of the etching treatment, to improve the strength of the composite material produced with these carbon fibers. The equipment, therefore, becomes complicated and it provides another cause for increase of production cost.

In addition to the macro-defects mentioned above, the strength is also affected by presence of micro-voids or micro-defects. Techniques are proposed to inhibit their generation. Techniques to densify precursor fibers for inhibiting their generation are proposed. A technique to densify undrawn fibers by optimizing the conditions of the coagulating bath is disclosed in Japanese Patent Laid-Open (Kokai) No. 59-82420, and a technique to densify drawn fibers by keeping the drawing temperature in a bath as high as possible is disclosed in Japanese Patent Publication (Kokoku) No. 6-15722. However, since the techniques for achieving densification tend to lower oxygen permeability into the fibers in a stabilization process, the improvement in tensile strength expressed as a resin impregnated strand of the obtained carbon fibers tends to be depreciated.

Therefore, the tensile strength of carbon fibers as a resin impregnated strand can be improved by these techniques only when precursor fibers are 0.8 denier or less in fineness of each single filament, or only when the carbon fibers are 6 $\mu$m or less in the diameter of a single filament. For carbon fibers thicker than 6 $\mu$m in diameter of a single filament, the improvement of tensile strength as a resin impregnated strand with these techniques is hard to obtain.

As for the polymer composition used to form precursor fibers, the use of any copolymerizable vinyl compound with acrylonitrile is proposed in Japanese Patent Laid-Open (Kokai) No. 59-82420, and copolymerization of p-chloroacrylonitrile, which is effective in lowering stabilization temperature, is proposed in Japanese Patent Publication (Kokoku) No. 6-27368. However, these proposals do not clarify the effect of improving strength.

Furthermore a technique designed to make the difference in oxygen content between the inner and outer layers of a stabilized single filament small, by copolymerizing an acrylate or methacrylate with acrylonitrile is proposed in Japanese Patent Laid-Open (Kokai) No. 2-84505. However, the obtained precursor fibers are low in density and inhibition of the coalescence between single filaments is also insufficient. As a result, the tensile strength of carbon fibers as a resin impregnated strand is as low as 5.1 GPa or less.

Precursor fibers made of polymer consisting of three or more components are proposed in Japanese Patent Publication (Kokoku) No. 6-15722. One of the components is specified as a stabilization accelerator which can be selected from acrylic acid, methacrylic acid, itaconic acid, their alkali metal salts and ammonium salts, and hydroxy esters of acrylic acid. Another component is specified as a spinning and drawing promoter which can be selected from lower alkyl esters of acrylic acid and methacrylic acid, allylsulfonic acid, methallylsulfonic acid, styrenesulfonic acid, their alkali metal salts, vinyl acetate and vinyl chloride. However, the effect in improving tensile strength as a resin impregnated strand by these components is not stated.

A technique to densify the structure of each single filament by making the temperature increase rate small or raising the tension of the fibers in the carbonization process is proposed in Japanese Laid-Open (Kokai) No. 62-110924. However, lowering the temperature increase rate means lowering carbonization speed and a larger apparatus, hence raising production cost. Raising the tension means lowering mechanical properties due to increase of fuzz in the fibers. Therefore, these techniques are limited in improving tensile strength.

Techniques to add fine particles of different compounds inside carbon fibers are proposed in Japanese Patent Publication (Kokoku) No. 61-58404 and Japanese Patent Laid-Open (Kokai) No. 2-251615 and 4-272236, and a technique to mix any of various resins with a polyacrylonitrile based polymer is proposed in Japanese Patent Laid-Open No. 5-195324. A technique in which atoms or molecules solid or gaseous at room temperature are ionized in vacuum and accelerated by an electric field, to be injected into the surface layer of each carbon fiber is proposed in Japanese Patent Laid-Open (Kokai) No. 3-18051.

However, in the case of carbon fibers containing fine particles, fine particles exist generally in each single filament and act as impurities to cut the single filaments in precursor production process and carbonization process, generating much fuzz. Therefore, these techniques lower the productivity, tensile strength and other mechanical properties of the carbon fibers.

A technique to mix fine particles containing a metal element, with the fibers, faces a problem that compressive strength of the obtained carbon fibers is adversely affected, since catalytic graphitization generates larger graphite crystallites. Even if a polymer is mixed with resin, instead of the fine particles, it is difficult to obtain carbon fibers with a homogeneous structure, and as a result the tensile strength as a resin impregnated strand is lowered.

On the other hand, techniques proposed for improving productivity include a technique to raise the traveling speed of the fibers in the precursor production process or carbonization process, and a technique to increase the number of single filaments per carbon fiber bundle. Although these techniques are effective in improving productivity, they lower the tensile strength of the obtained carbon fibers (as a resin impregnated strand) at the present level of the techniques.

If the diameter (fineness) of single filaments constituting carbon fibers is increased, the tensile strength of the carbon fibers (as a resin impregnated strand) is greatly lowered disadvantageously at the present level of techniques, although productivity can be improved.

Japanese Patent Publication (Kokoku) No. 7-37685 proposes carbon fibers with a tensile strength of 6.5 GPa or more as a resin impregnated strand, but the diameter of single filaments disclosed is as small as 5.5 $\mu$m or less, and carbon fibers with high tensile strength (as a resin impregnated strand) consisting of single filaments with a diameter larger than 6 $\mu$m excellent are not disclosed.

In addition, since the technique must undergo a complicated process of electrolyzing in a high temperature electrolyte containing nitrate ions as an essential component, and subsequently heating in an inert atmosphere for adjusting surface chemical functions, the rise of production cost cannot be avoided. Though the carbon fibers obtained according to this technique are as thin as 5.5 $\mu$m or less in single filament diameter, the tensile elongation of the carbon fibers as a resin impregnated strand is as low as 2.06% at the highest.

This suggests that if the single filament diameter is smaller, the modulus distribution in each single filament of carbon fibers becomes smaller, to raise the strength of carbon fibers, but at the same time, to raise the Young's modulus of the carbon fibers. So, even if the single filament diameter is smaller than 6 $\mu$m, it is impossible to improve the tensile elongation of the carbon fibers as a resin impregnated strand to a value higher than 2.5%.

The technique to improve the tensile strength of carbon fibers as a resin impregnated strand by decreasing the fineness of single filaments has a limit, since single filaments having a fineness of less than 0.5 denier are damaged remarkably in the production process of precursor fibers.

DISCLOSURE OF THE INVENTION

The inventors studied the problems of the above prior arts, and to achieve the objective of providing carbon fibers satisfying the above requirements, at first examined the production process of carbon fibers. As a result, they succeeded in developing a process for producing carbon fibers, as described later. Furthermore, as a result, they succeeded in developing carbon fibers with properties described later, and acrylic fibers (precursor fibers) with properties described later to be used for producing said carbon fibers.

The present invention has the following constitution.

(A) Carbon fibers of the present invention:

(A1) Carbon fibers consisting essentially of a plurality of single filaments, characterized by satisfying the following relation:

$$\sigma \geqq 11.1-0.75d \quad \text{(I)}$$

where σ is the tensile strength of said carbon fibers as a resin impregnated strand (in GPa) and d is the average diameter of said single filaments (in μm).

(A2) Carbon fibers, stated in said (A1), which satisfy the following relation:

$$d>6\ \mu\text{m and } \sigma \geqq 5.5\ \text{GPa} \quad \text{(II)}$$

(A3) Carbon fibers consisting essentially of a plurality of single filaments, characterized by satisfying the following relation:

$$\epsilon \geqq 2.5\% \quad \text{(III)}$$

where ε is the tensile elongation of said carbon fibers as a resin impregnated strand (in %).

(A4) Carbon fibers, stated in said (A1), which satisfy the above formula (III).

(A5) Carbon fibers, stated in said (A1), which satisfy the above formulae (II) and (III).

(A6) Carbon fibers consisting essentially of a plurality of single filaments, characterized by satisfying the following relation:

$$K_{IC} \geqq 3.5\ \text{MPa}\cdot m^{1/2} \quad \text{(IV)}$$

where $K_{IC}$ is the critical stress intensity factor (in $\text{MPa}\cdot\text{m}^{1/2}$) of said single filaments.

(A7) Carbon fibers, stated in said (A6), which satisfy the above formula (II).

(A8) Carbon fibers consisting essentially of a plurality of single filaments, characterized by satisfying the following relation:

$$K_{IC} \geqq -0.018S+4.0 \quad \text{(V)}$$

where $K_{IC}$ is the critical stress intensity factor of said single filaments (in $\text{MPa}\cdot\text{m}^{1/2}$), and S is the cross sectional area of each of said single filaments (in $\mu\text{m}^2$).

(A9) Carbon fibers, stated in said (A2), which satisfy the above formula (V).

(A10) Carbon fibers, stated in any one of said (A1) through (A9), which satisfy the following relation:

$$BS \geqq 400\ \text{N} \quad \text{(VI)}$$

where BS is the tensile strength of carbon fiber bundles (in N).

(A11) Carbon fibers, stated in any one of said (A1) through (A9), which satisfy the following relation:

$$RD \geqq 0.05 \quad \text{(VII)}$$

where RD is the difference between the inner and outer layers of each of said single filaments evaluated with RAMAN.

(A12) Carbon fibers, stated in any one of said (A1) through (A9), which satisfy the following relation:

$$AY \geqq 65 \quad \text{(VIII)}$$

where AY is the difference between the inner and outer layers of each of said single filaments evaluated with AFM.

(A13) Carbon fibers, stated in any one of said (A1) through (A9), wherein when the cross section of each of said single filaments is observed by TEM, a ring pattern does not exist between the inner and outer layers of the single filament.

(A14) Carbon fibers, stated in any one of said (A1) through (A9), which satisfy the following relation:

$$MD \leqq 50\% \quad \text{(IX)}$$

where MD is the percentage of failure due to macro-defects found when the fracture surfaces of said single filaments are observed.

Said carbon fibers can be produced by stabilizing and subsequently carbonizing the following acrylic fibers (precursor fibers).

(B) Acrylic fibers (precursor fibers) of the present invention:

(B1) Acrylic fibers, (a) comprising an acrylic polymer consisting essentially of 95 mol % or more of acrylonitrile and 5 mol % or less of a stabilization accelerator, (b) satisfying the following relation:

$$5 \leqq \Delta L \leqq 42$$

where ΔL is the difference in lightness due to iodine adsorption, (c) satisfying the following relation:

$$CR > 1/6$$

where CR is the ratio of the oxygen content of the inner layer to the oxygen content of the outer layer (Oxygen Content Ratio) found in the oxygen content distribution in the cross sectional direction of each of single filaments obtained by heating the single filaments in air of 250° C. at atmospheric pressure for 15 minutes and in air of 270° C. at atmospheric pressure for 15 minutes, and analyzing by secondary ion mass spectrometry (SIMS), (d) having silicone compounds in the surfaces of the single filaments, and (e) having a crosslinking accelerator in the surfaces of the single filaments.

(B2) Acrylic fibers, stated in said (B1), wherein the crosslinking accelerator is an ammonium compound.

(B3) Acrylic fibers, stated in said (B1), wherein fine particles exist on the surfaces of the single filaments.

(B4) Acrylic fibers, (a) comprising an acrylic polymer consisting of 95 mol % or more of acrylonitrile and 5 mol % or less of a stabilization promoter, (b) having a stabilization inhibitor in the surface layers of the single filaments, and (c) having the highest silicon content region in the surface layer of each of the single filaments.

(B5) Acrylic fibers, stated in said (B4), wherein the stabilization inhibitor is one or more elements selected from B, Ti, Zr, Y, Cr, Fe, Al, Ca, Sr, Mg and lanthanoide series, or a compound containing one or more of these elements.

(B6) Acrylic fibers, stated in said (B5), which satisfy the following relations:

(a) 0.001 wt %≦DV≦10 wt % where DV is the stabilization inhibitor content (in wt %), and (b) 0.01 wt %≦SV≦5 wt % where SV is the silicon content (in wt %).

(B7) Acrylic fibers, stated in said (B5), which satisfy the following relations:

(a) 5≦DCR≦1,000 where DCR is the ratio of the stabilization inhibitor content in the outer layer of each single filament to the stabilization inhibitor content in the inner layer, and (b) 10≦SCR≦10,000 where SCR is the ratio of the silicon content in the outer layer of each single filament to the silicon content in the inner layer.

Said acrylic fibers can be produced by the following process.

(C) A process for producing acrylic fibers (precursor fibers) of the present invention:

(C1) A process for producing acrylic fibers, comprising:

(a) using an acrylic polymer consisting of 90 mol % or more of acrylonitrile, densifying accelerator, drawing promoter, stabilization accelerator and oxygen permeation promoter as a raw material, (b) wet-spinning or dry jet spinning it, (c) drawing the obtained fibers in water of 60° C. or higher without allowing the swelling degree of the single filaments to exceed 100%, and (d) applying an oil consisting of an amino-modified silicone compound, epoxy-modified silicone compound and crosslinking accelerator, to the obtained fibers, by 0.01 wt % to 5 wt % based on the weight of the fibers.

(C2) A process for producing acrylic fibers, stated in said (C1), wherein the crosslinking accelerator is an ammonium compound.

(C3) A process for producing acrylic fibers, stated in said (C1), wherein fine particles are contained in said oil.

(C4) A process for producing acrylic fibers, stated in said (C1), wherein the kinetic viscosity of the amino-modified silicone compound is 200 cSt to 20,000 cSt and the kinetic viscosity of the epoxy-modified silicone compound is 1,000 cSt to 40,000 cSt.

(C5) A process for producing acrylic fibers, stated in said (C1), wherein the oiled fibers are further drawn to 3~7 times in a high temperature heat carrier.

(C6) A process for producing acrylic fibers, stated in said (C5), wherein the high temperature heat carrier is steam.

(C7) A process for producing acrylic fibers, comprising:

(a) using an acrylic polymer consisting of 95 mol % or more of acrylonitrile and 5 mol % or less of a stabilization accelerator as a raw material, (b) wet-spinning or dry jet spinning it, (c) drawing the obtained fibers in water of 30° C. or higher without allowing the swelling degree of the single filaments to exceed 200%, and (d) applying an oil consisting of a stabilization inhibitor and silicone compounds to the obtained fibers.

(C8) A process for producing acrylic fibers, stated in said (C7), wherein the stabilization inhibitor is one or more elements selected from B, Ti, Zr, Y, Cr, Fe, Al, Ca, Sr, Mg and lanthanoide series, or a compound containing one or more of these elements.

(C9) A process for producing acrylic fibers, stated in said (C7), wherein the silicone compounds are an amino-modified silicone compound and an epoxy-modified silicone compound.

(C10) A process for producing acrylic fibers, stated in said (C9), wherein the kinetic viscosity of the amino-modified silicone compound is 200 cSt to 20,000 cSt and the kinetic viscosity of the epoxy-modified silicone compound is 1,000 cSt to 40,000 cSt.

(C11) A process for producing acrylic fibers, stated in said (C7), wherein the residue rate after heat treatment of the silicone compounds is 20% or more.

(C12) A process for producing acrylic fibers, stated in said (C7), wherein the oiled fibers are further drawn to 3~7 times in a high temperature heat carrier.

(C13) A process for producing acrylic fibers, stated in said (C12), wherein the high temperature heat carrier is steam.

The acrylic fibers produced by said process for producing acrylic fibers are processed into carbon fibers according to the following process.

(D) A process for producing carbon fibers of the present invention:

(D1) A process for producing carbon fibers, comprising the steps of stabilizing and subsequently carbonizing the acrylic fibers obtained by the process for producing acrylic fibers stated in any one of said (C1) through (C12).

(D2) A process for producing carbon fibers, stated in said (D1), wherein the temperature of the oxidizing atmosphere for the stabilizing is 200° C. to 300° C. and the temperature of the inert atmosphere for carbonizing is 1,100° C. to 2,000° C.

MOST PREFERRED EMBODIMENTS OF THE INVENTION

The above are the gist of the carbon fibers, acrylic fibers and production processes thereof of the present invention. The present invention is described below in more detail.

<Relation between the average diameter of single filaments of carbon fibers (hereinafter may be simply called the single filament diameter) (d) (in μm) and the tensile strength of carbon fibers as a resin impregnated strand (hereinafter may be simply called the strength of carbon fibers) (σ) (in GPa)>

The carbon fibers of the present invention are characterized in that the diameter of each of the single filaments constituting the carbon fibers and the strength of the carbon fibers satisfy the following relation:

$$\sigma \geqq 11.1 - 0.75d \quad \text{(I)}$$

The conventional carbon fibers do not satisfy this relation. The carbon fibers of the present invention which satisfy this relation are higher in the strength of carbon fibers compared to the conventional carbon fibers with the same single filament diameter, i.e., of the same production cost, and so are excellent in the cost performance obtained by dividing the strength by the production cost.

It is more preferable that the single filament diameter and the strength of carbon fibers satisfy the following formula (Ia), and further more preferable is to satisfy the following formula (Ib).

$$\sigma \geqq 11.6-0.75d \quad \text{(Ia)}$$

$$\sigma \geqq 12.1-0.75d \quad \text{(Ib)}$$

It is preferable that the strength of carbon fibers is higher, but according to the finding by the inventors, the upper limit is a level satisfying the following formula (Ic):

$$\sigma \leqq 20.0-0.75d \quad \text{(Ic)}$$

<Single filament diameter of carbon fibers (d) (in $\mu$m) >

As one of preferable conditions of the carbon fibers of the present invention, the diameter of each of the single filaments constituting the carbon fibers is larger than 6 $\mu$m. The reason is that if the single filament diameter is 6 $\mu$m or less, the productivity is low to raise the cost. Therefore, in view of productivity, it is preferable that the single filament diameter is larger than 6 $\mu$m. More preferable is larger than 6.2 $\mu$m, and further more preferable is larger than 6.5 $\mu$m. Still further more preferable is larger than 6.8 $\mu$m.

However, there is an upper limit. If the single filament diameter is too large, the oxygen permeation into the center of fiber is insufficient in the carbonization process, especially in the stabilization process, not allowing homogeneous stabilization. To avoid it, the stabilization temperature must be lowered, and in this case, the time taken for carbonization becomes long. As a result, the productivity is lowered or larger equipment must be used to raise the equipment cost disadvantageously. So, it is preferable that the single filament diameter is 15 $\mu$m or less, and more preferable is 10 $\mu$m or less.

<Strength of carbon fibers ($\sigma$) (in GPa)>

As one of preferable conditions of the carbon fibers of the present invention, the strength of the carbon fibers is 5.5 GPa or more. In the case of conventional carbon fibers consisting of single filaments with a diameter of 6 $\mu$m or more each, their strength is less than 5.5 GPa, and even if they are used for improving the strength of any structure, they do not provide a remarkable effect in their application to reduce the weight of the structure. To satisfy the demand in this field at present, it is preferable that the strength of carbon fibers is 5.5 GPa or more. More preferable is 6 GPa or more, and further more preferable is 6.4 GPa or more. Still further more preferable is 6.8 GPa or more, and especially preferable is 7 GPa or more. It is preferable that the strength of carbon fibers is higher, but according to the finding by the inventors, the upper limit in the strength of carbon fibers is about 20 GPa, since there is an upper limit in the tensile strength of carbon fibers as a resin impregnated strand.

<Definition of the average diameter of single filaments of carbon fibers (d) (in $\mu$m)>

The single filament diameter is defined as the diameter of a single filament obtained by dividing the weight (g/m) of carbon fibers consisting of many single filaments per unit length by the density (g/m$^3$) of the carbon fibers, to obtain the cross sectional area of the carbon fibers, dividing the cross sectional area of the carbon fibers by the number of single filaments constituting the carbon fibers, to obtain the cross sectional area of each single filament, and calculating the diameter of the single filament, assuming that the cross sectional shape of the single filament is a complete circle. The cross sectional shapes of single filaments of the carbon fibers include those close to complete circles, and also those close to triangles, dumbbells and straight lines. Irrespective of the cross sectional shapes, the average single filament diameter is obtained according to this definition.

<Definition of the tensile strength of carbon fibers as a resin impregnated strand ($\sigma$) (in GPa)>

The strength of carbon fibers is obtained according to the method stated in J1S R 7601 "Resin Impregnated Strand Testing Methods". However, the resin impregnated strand of the carbon fibers to be measured is formed by impregnating carbon fibers with "Bakelite" ERL4221 (100 parts by weight)/boron trifluoride monoethylamine (3 parts by weight)/acetone (4 parts by weight), and curing at 130° C. for 30 minutes. Six strands should be measured, and the average value of the measured values is adopted as the strength of the carbon fibers.

<Tensile elongation of carbon fibers as a resin impregnated strand (hereinafter may be simply called the elongation of carbon fibers) ($\epsilon$) (in %)>

The carbon fibers of the present invention are characterized in that their elongation ($\epsilon$) is 2.5% or more.

Conventional carbon fibers with an elongation of 2.5% or more are not known. Since carbon fibers with an elongation of 2.5% or more can be obtained according to the present invention, carbon fibers can be applied also in other fields where carbon fibers with a larger elongation are demanded, for example, as energy absorbing goods such as golf shafts, helmets and ships' bottoms, and also as CNG tanks and aircraft structures.

It is preferable that the elongation of carbon fibers is 2.7% or more, and more preferable is 2.9% or more. According to the finding by the inventors, the upper limit in the elongation of carbon fibers is 5%.

It is preferable that carbon fibers according to the invention satisfy the above elongation and also satisfy the requirement stated in said (A1).

More preferable carbon fibers of the present invention satisfy the above elongation and also satisfy the requirements stated in said (A1) and (A2).

<Definition of the tensile elongation of carbon fibers as a resin impregnated strand ($\epsilon$) (in %)>

The elongation of carbon fibers is obtained according to the method stated in J1S R 7601 "Resin Impregnated Strand Testing Methods". The resin used, the formation and number of strands are as described for the definition of the strength of carbon fibers.

<Critical stress intensity factor of single filaments of carbon fibers ($K_{IC}$ (in MPa·m$^{1/2}$))>

The carbon fibers of the present invention are characterized by having a critical stress intensity factor of 3.5 MPa·m$^{1/2}$ or more.

Conventional carbon fibers with a critical stress intensity factor of 3.5 MPa·m$^{1/2}$ or more are not known. Since carbon fibers with a critical stress intensity factor of 3.5 MPa·m$^{1/2}$ can be obtained according to the present invention, the carbon fibers can manifest higher strength compared to the conventional carbon fibers with a smaller critical stress intensity factor even if defects of the same sizes and quantities as those in the conventional carbon fibers exist.

It is preferable that the critical stress intensity factor is 3.7 MPa·m$^{1/2}$ or more. More preferable is 3.9 MPa·m$^{1/2}$ or more, and especially preferable is 4.1 MPa·m$^{1/2}$ or more. According to the finding by the inventors, the upper limit of the critical stress intensity factor is 5 MPa·m$^{1/2}$.

Preferable carbon fibers of the present invention satisfy the above critical stress intensity factor, and also satisfy the requirement stated in said (A2).

<Definition of the critical stress intensity factor of single filaments of carbon fibers ($K_{IC}$ (in $MPa \cdot m^{1/2}$))>

The critical stress intensity factor of single filaments of carbon fibers is obtained according to the following method. A fracture surface of a single filament of a carbon fiber includes a flat zone with relatively less roughness in the initial failure (an initial flat zone) and a radial streak zone with high roughness. Since the failure of a carbon fiber usually starts from the surface, the initial flat zone exists like a semi-circle with the failure start point observed near the surface of the single filament as the center. Between its size (depth from the surface) c and the single filament strength σ a (the measuring method is described later), the relation of the following formula (a-1) can be observed (K. Noguchi, T. Hiramatsu, T. Higuchi and K. Murayama, Carbon '94 Int. Carbon Conf., Bordeaux, (1984) p. 178).

$$\sigma a = k/c^{1/2} \text{(where k is a proportional constant)} \quad \text{(a-1)}$$

On the other hand, the critical stress intensity factor has the relation of the following formula (a-2) with a size of the initial flat zone c and the single filament strength σ a:

$$K_{IC} = (M \cdot \sigma a/\phi) \cdot (\pi \cdot c)^{1/2} \quad \text{(a-2)}$$

where M and ϕ are constants. Since the size c of the initial flat zone is small compared to the single filament diameter, the initial flat zone can be assumed to be a half-moon shaped surface crack with size c in a semi-infinite medium. In this case, M=1.12 and $\phi=\pi/2$. Using these constants, from the formulae (a-1) and (a-2), the critical stress intensity factor of a carbon fiber can be obtained from the following formula (a-3):

$$K_{IC} = 1.27xk \quad \text{(a-3)}$$

In this way, by examining the relation between the size c of the initial flat zone and the single filament strength pa of a certain carbon fiber, the critical stress intensify factor $K_{IC}$ can be obtained. The proportional constant k is explained later.

The method for examining the relation between the size c of the initial flat zone and the single filament strength pa is described below. At first, a bundle of carbon fibers with a length of about 20 cm is prepared, and if a sizing agent is sized on the carbon fibers, the carbon fibers are immersed in acetone, etc., to remove the sizing agent. The bundle is divided into four bundles respectively consisting of almost the same number of filaments. From the four bundles, single filaments are sampled sequentially. The sampled single filaments are placed on a base card with a rectangular hole of 50 mm×5 mm, at a central position in the width of the hole, to cross over both the ends of the hole in the longitudinal direction of the hole. At positions of 2.5 mm outside both the ends of the hole, one each 5 mm×5 mm card of the same material is overlapped, and the overlapped cards are bonded together respectively using an instantaneous adhesive agent, to have the single filaments fixed. The cards with the single filaments fixed are installed in a tension tester, and the cards are cut at both sides of the hole without cutting the single filaments and are entirely immersed in water. A tensile test is conducted at a test length of 50 mm at a strain rate of 1%/min in water.

After the single filaments are fractured, the primary fracture surfaces are carefully sampled from water, and mounted on an SEM sample stage. The secondary fracture surfaces can be identified in reference to the appearance of each fracture surface different in one half of it since the filaments are fractured in a bending or compressive mode. If the secondary fracture is too large to sample the primary fracture, it is preferable to change the liquid to have the sample immersed, to a liquid with a viscosity higher than that of water, or to change the test length.

The SEM observation conditions are as follows: To photograph from right above the fracture surface. Sample mounting: carbon adhesive tape. Sample coating: platinum-palladium. Accelerating voltage: 20 kV. Emission current: 10 μA. Working distance: 15 mm. Magnification: 10,000 times or more.

Excluding the single filaments which do not allow the initial flat zone of the fracture surface to be observed due to contamination, etc., fifty single filaments are observed as above. Furthermore, in the formula (a-1), the gradient k between the inverse number of the root of the size c of the initial flat zone and the single filament strength σ a is obtained by the least square method, and is substituted into the formula (a-3), for obtaining the critical stress intensity factor $K_{IC}$.

<Relation between critical stress intensity factor ($K_{IC}$) (in $MPa \cdot m^{1/2}$) and the cross sectional area of each single filament (S) (in $\mu m^2$)>

The carbon fibers of the present invention are characterized in that the relation between the critical stress intensity factor and the cross sectional area of each single filament satisfies the following formula (V):

$$K_{IC} \geqq -0.018S + 4.0 \quad \text{(V)}$$

Usually the critical stress intensity factor tends to decline when the cross sectional area of each single filament is larger, and the conventional carbon fibers do not satisfy this relation. The constant 4.0 is in $MPa \cdot m^{1/2}$, and the coefficient 0.018 is in $(MPa \cdot m^{1/2})/(\mu m^2)$.

It is preferable that the relation between the critical stress intensity factor and the cross sectional area of each single filament satisfies the following formula (V-a), and it is more preferable to satisfy the following formula (V-b).

$$K_{IC} \geqq -0.018S + 4.2 \quad \text{(V-a)}$$

$$K_{IC} \geqq -0.018S + 4.4 \quad \text{(V-b)}$$

It is preferable that the upper limit of the critical stress intensity factor is higher, but according to the finding by the inventors, it is in the range of the following formula (V-c).

$$K_{IC} \leqq -0.018S + 5.5 \quad \text{(V-c)}$$

Preferable carbon fibers of the present invention satisfy the above relation between the critical stress intensity factor and the cross sectional area of each single filament, and also satisfy the requirement stated in said (A2).

As described above, the carbon fibers of the present invention have a higher strength, elongation and critical stress intensity factor than the conventional carbon fibers even if the single filament diameter is larger, and are very excellent in cost performance. Furthermore, the carbon fibers of the present invention have a high elongation and critical stress intensity factor irrespective of the diameter of the single filaments constituting the carbon fibers.

<Definition of the cross sectional area of each single filament (S) (in $\mu m^2$)>

The cross sectional area of each single filament is obtained from the following formula (b-1):

$$S = (Y/(F \times \rho)) \times 1{,}000 \quad \text{(b-1)}$$

where Y is the yield of carbon fibers (weight per unit length) (g/m); F is the number of filaments; and ρ is the specific gravity.

<Tensile strength of a carbon fiber bundle (BS) (in N)>

Preferable carbon fibers of the present invention satisfy the requirements of any one of said (A1) through (A9), and are characterized in that the tensile strength of a carbon fiber bundle is 400 N or more. The tensile strength of a carbon fiber bundle means the tensile strength of carbon fibers not impregnated with any resin, as defined later. If the tensile strength of a carbon fiber bundle is low, the carbon fibers not yet impregnated with any resin are liable to generate fuzz disadvantageously when handled. It is preferable that the tensile strength of a carbon fiber bundle is 450 N or more, and more preferable is 500 N or more.

Thus, carbon fibers with a high tensile strength are excellent in handling property (processability) in the state where they are not impregnated with any resin. For example, there is an effect that the number of abrasion fuzz pieces generated when the carbon fibers are abraded is small. The number of abrasion fuzz pieces of the carbon fibers of the present invention is usually 20/m or less. In the case of excellent carbon fibers, it is 10/m or less, and in the case of more excellent carbon fibers, it is 5/m or less.

To measure the tensile strength of a carbon fiber bundle, the test length of the carbon fibers is as long as 50 mm. Since carbon fibers are fractured by the largest defect existing in this length, the tensile strength of a carbon fiber bundle is an indicator for judging whether any defect due to the coalescence between single filaments exists in the carbon fibers.

<Definition of the tensile strength of a carbon fiber bundle (BS) (in N)>

Carbon fibers, not impregnated with any resin, are arrested by air chucks at a test length of 50 mm, and pulled at a tensile speed of 5 to 100 m/min, to measure a fracture strength. The measurement is carried out 5 times, and the average value is obtained. Then, to eliminate the influence of the thickness of carbon fibers, the value is proportionally converted into a corresponding value of the carbon fibers with a cross sectional area of 0.22 $mm^2$. The obtained value is adopted as the tensile strength of the carbon fiber bundle. If the convergence of carbon fibers is too poor to arrest by the chucks in good arrangement when the tensile strength is measured, it is preferable to feed the carbon fibers through a water bath, for measuring the carbon fibers wetted with water.

<Definition of the number of abrasion fuzz pieces of carbon fibers (in number/m)>

An abrasion device in which five stainless steel rods respectively with a diameter of 10 mm and smooth on the surface are arranged in parallel at 5 cm intervals and zigzag to allow carbon fibers to pass them in contact with their surfaces at a contact angle of 120° is used as a measuring instrument. In this device, a tension of 0.08 g per denier is applied to the carbon fibers at the inlet, and the carbon fibers are passed in contact with the five rods at a speed of 3 m/min. From a side, a laser beam is applied at right angles to the carbon fibers, and the number of fuzz particles is detected and counted by a fuzz detector, being expressed as the number of fuzz particles per 1 m of carbon fibers.

<Difference between the inner and outer layers of each single filament of carbon fibers evaluated with RAMAN (RD)>

The carbon fibers of the present invention do not allow a tensile stress to be easily concentrated on the surfaces. This can be understood from that the crystallinity distribution in each single filament of the carbon fibers is more uniform than that of conventional carbon fibers. Preferable carbon fibers of the present invention satisfy the requirements of any one of said (A1) through (A9), and are characterized in that the difference (RD) between the inner and outer layers of each single filament in crystallinity evaluated with RAMAN, is 0.05 or less.

Carbon fibers having small in the structural difference between the inner and outer layers shows small in the difference (RD) between the inner and outer layers, but the difference (RD) between the inner and outer layers of the conventional carbon fibers exceed 0.05. The difference (RD) between the inner and outer layers of the carbon fibers of the present invention is 0.05 or less. Excellent carbon fibers show 0.045 or less, and more excellent ones show 0.04 or less. Further more excellent ones show 0.035 or less.

<Definition of the difference (RD) between the inner and outer layers of each single filament of carbon fibers evaluated with RAMAN>

The evaluation of the crystallinity distribution with RAMAN is carried out as described below.

A carbon fiber is embedded in acrylic resin, and is wet-polished using a diamond slurry, for observation. The spot diameter of the RAMAN microprobe used is about 1 μm, and to further enhance the position resolving power, the carbon fiber is tilted when polished. The tilt angle of the filament is about 3 degrees against the fiber axis.

The following RAMAN measurement conditions are used to analyze the Stokes' line. Instrument: Ramanor T-64000 (produced by Jobin Yvon), Microprobe beam splitter: right, Objective lens: ×100, Light source: $Ar^+$ laser (5145 Å), Spectroscope composition: 640 mm triple monochromator, Diffraction grating: spectrograph 600 gr/mm, and Dispersion: Single 21 Å/mm, Detector CCD: Jobin Yvon 1024×256. Since a tilted carbon fiber is polished, the depth from the surface corresponding to the measuring point is obtained as follows. Measuring depth=sin θ×d, where d is the distance from the end on a major axis, and θ is the tilt angle of the filament, sin θ=a/b, where a and b are the lengths of the major axis and minor axis of the ellipse of CF cross section. As the parameter of RAMAN band, $I_{1480}/I_{1580}$ was used as the parameter of crystallinity, where $I_{1580}$ is the RAMAN band intensity near 1580 $cm^{-1}$ (attributable to the structure peculiar to graphite crystal), and $I_{1480}$ is the intensity in the trough (near 1480 $cm^{-1}$) between two RAMAN bands near 1580 $cm^{-1}$ and near 1350 $cm^{-1}$.

The difference (RD) between inner and outer layers is obtained from the following formula:

$$RD=Ro-Ri \quad \text{(c-1)}$$

where Ro is the $I_{1480}/I_{1580}$ in a depth range of 0 to 0.1 μm from the surface and Ri is the $I_{1480}/I_{1580}$ in a range near the center where the depth from the surface is almost equal to the radius of the single filament.

<Difference (AY) between the inner and outer layers of each single filament of carbon fibers obtained by AFM>

The carbon fibers of the present invention are smaller than the conventional carbon fibers in the difference in Young's modulus between the inner and outer layers of each single filament. The Young's modulus distribution is measured by AFM. Preferable carbon fibers of the present invention satisfy the requirements of any one of said (A1) to (A9), and are characterized by being 65 or more in the difference (AY) between inner and outer layers obtained by AFM.

<Definition of the difference (AY) between the inner and outer layers of each single filament of carbon fibers obtained by AFM>

The Young's modulus distribution by AFM is measured by using the AFM force modulation method in which the angle amplitudes caused by vibrating a cantilever are surface-analyzed. A carbon fiber to be observed is embedded in a room temperature curing epoxy resin, and the resin is cured. Then, the face perpendicular to the axial direction of the carbon fiber is polished for observation. The observation conditions of the AFM force modulation method are as follows. Observation Instrument: NanoScope III AFM Dimension 3000 Stage System produced by Digital Instruments, Probes: Si Cantilever Integrated Point Probes produced by Digital Instruments, Scanning mode: Force modulation mode, Scanning range: 20 μm×20 μm, Scanning speed: 0.20 Hz, Number of pixels: 512×512, and Measuring environment: Room temperature air.

From the force modulation image obtained under these conditions, a cross sectional view across the center of the carbon fiber is prepared, and the modulus distribution is estimated as described below using the phenomenon that the angle amplitude is large in a region with a low modulus and small in a region with a high modulus.

With attention paid to a certain single filament, the resin portions existing outside both the ends of the single filament where the angle amplitude is largest are expressed as 0, while the inside portion of the single filament where the angle amplitude is small is expressed as 100, and numbers are proportionally distributed in the ranges between them. Then, the angle amplitudes are converted into Young's modulus index values Ya. In this case, the value of the portion deeper than 0.5 μm from the surface of the single filament where the Young's modulus index is smallest is expressed as Ym. Similar measurement is carried out with optional 20 or more single filaments, and the average value of Ym is identified as the difference (AY) between inner and outer layers. As a result, a carbon fiber with a small Young's modulus distribution shows a large AY value.

Conventional carbon fibers of 65 or more in the difference (AY) in Young's modulus between inner and outer layers are not known. The carbon fibers of the present invention are 65 or more in the difference (AY) in Young's modulus between inner and outer layers. Excellent ones are 70 or more, and more excellent ones are 75 or more. Further more excellent ones are 80 or more.

<Existence of a ring pattern between the inner and outer layers of each single filament of carbon fibers observed by TEM>

Preferable carbon fibers of the present invention satisfy the requirements of any one of said (A1) to (A9), and is characterized in that when the cross section of a carbon fiber is observed by TEM, a ring pattern is not observed between the inner and outer layers. In this case, the outer layer in TEM observation refers to the portion from the surface to ⅕ of the radius of the single filament, and the inner layer refers to the portion from the center to ⅕, more strictly 1/10 of the radius of the single filament.

In the stabilization of precursor fibers of carbon fibers, the progression of stabilization reaction is determined by oxygen diffusion, and oxygen is hard to permeate the inner layer when each single filament of the precursor fibers is thick or too dense. In this case, the stabilization of the inner layer of each single filament is retarded, to cause difference in the progression of stabilization between the inner and outer layers, to form a two-layer structure. So, in the observation with TEM, a ring pattern attributable to the structural difference is observed between the inner and outer layers. Such a carbon fiber does not show a high strength or elongation. As the case may be, a two-layer structure with a blackish inner layer and a thin outer layer is formed, to make the ring pattern unclear, and this structure is not preferable either. To obtain a carbon fiber with a high strength and elongation, it is necessary that no two-layer structure is substantially observed, and that the structure looks homogeneous.

<Definition of the existence of a ring pattern between the inner and outer layers of each single filament of carbon fibers observed by TEM>

The respective single filaments constituting carbon fibers are paralleled in fiber axis direction, and embedded in a room temperature curing epoxy resin, and the resin is cured. The cured carbon fiber embedded block is trimmed to expose at least two or three single filaments of carbon fibers, and a very thin cross section with a thickness of 150 to 200 Å is prepared using a microtome equipped with a diamond knife. The very thin cross section is placed on a micro-grid vapor-deposited with gold, and photographed using a high resolution transmission electron microscope. Electron microscope Model H-800 (transmission type) produced by Hitachi, Ltd. is used for measuring at an accelerating voltage of 200 kV at about 20,000 times.

<Percentage of failure (MD) due to the macro-defects on the fracture surfaces of single filaments of carbon fibers (in %)>

Preferable carbon fibers of the present invention satisfy the requirements of any one of said (A1) to (A9) and are characterized by being 50% or less in the percentage of macro-defects observed on the fracture surfaces of single filaments. If a tensile fracture surface of a single filament is observed, radially propagating streaks of fracture is observed from the start point of fracture on the fracture surface. So, the start point of fracture can be identified. At the start point of fracture, in some cases, a macro-defect such as flaw, deposit, dent, longitudinal streak or inside void is observed, and in other cases, anything like defect is not observed with SEM.

If a macro-defect exists, it causes the single filament to be fractured at a low tensile stress however improved the substrate, i.e., micro-structure of the carbon fiber may be, and any carbon fiber with a higher strength cannot be obtained. Therefore, it is better that the number of macro-defects is smaller. It is preferable that the percentage of macro-defects is 40% or less. More preferable is 30% or less, and further more preferable is 20% or less. According to the finding by the inventors, the lower limit is about 5%.

<Definition of macro-defects on fracture surfaces of single filaments of carbon fibers>

The fracture surface of each single filament of carbon fibers can be observed according to the method described in "The method for examining the relation between the size c of the initial flat zone and the single filament strength σ a" in the above. Macro-defects refer to defects, the fracture cause of which can be identified and which have a size of 0.1 μm or more. Fifty or more single filaments, excluding those which do not allow the observation of the fracture surface due to contamination, etc., are observed, and the percentage of the number of single filaments fractured due to macro-defects to the total number of single filaments which allow the observation of each fracture surface is defined as the percentage of macro-defects (MD).

<Tensile modulus of carbon fibers as a resin impregnated strand (hereinafter may be simply called the modulus of carbon fibers) (YM) (in GPa)>

Preferable carbon fibers of the present invention are characterized by being 200 GPa or more, preferably 230 GPa or more in modulus. The elongation of carbon fibers can be raised by keeping the modulus of carbon fibers at lower than 200 GPa, but if the modulus is too low, the rigidity of the composite material obtained from them may decline, it will be necessary to make the material thicker, hence raise the cost. On the other hand, to manifest a high modulus, high temperature carbonization is necessary, and the strength of carbon fibers tends to decline. So, it is preferable that the upper limit of modulus is 600 GPa or less. More preferable is 400 GPa or less, and further more preferable is 350 GPa or less.

<Definition of the tensile modulus (YM) of carbon fibers as a resin impregnated strand (in GPa)>

The modulus of carbon fibers is obtained according to the method stated in J1S R 7601 "Resin Impregnated Strand Testing Methods". The resin used, the formation of the strand, and the number of the strands to be measured are as described in the definition of the strength of carbon fibers.

<Spreadability of single filaments of carbon fibers>

It is preferable that the carbon fibers of the present invention are 10 mm or more in the spreadability of a carbon fiber bundle consisting of 12,000 single filaments (spreadability per 12,000 filaments). If the spreadability of a bundle is less than 10 mm, the bundle is not sufficiently spread when the carbon fibers are impregnated with a resin, to make a prepreg, and the strength of carbon fibers may not be able to be sufficiently manifested when a composite material is produced by using the carbon fibers. It is more preferable that the spreadability of a bundle is 15 mm or more, and further more preferable is 20 mm or more.

<Surface silicon content (Si/C) of carbon fibers measured by X-ray photoelectron spectroscopy (ESCA)>

It is preferable that the carbon fibers of the present invention is 0.001 to 0.30 in the surface silicon content Si/C of the carbon fibers measured by X-ray photoelectron spectroscopy (ESCA). That is, to obtain carbon fibers with a high strength and elongation, it is important to prevent the coalescence between single filaments by using a silicone oil with high heat resistance described later, in the spinning and drawing process, and so silicon exists on the surfaces of the carbon fibers obtained after carbonization. It is more preferable for inhibiting the coalescence between single filaments that the surface silicon content Si/C is 0.01 or more, and further more preferable is 0.02 or more. If the silicone oil is applied too much, the strength of carbon fibers rather declines. So it is preferable that the surface silicon content Si/C is 0.30 or less. More preferable is 0.20 or less, and further more preferable is 0.10 or less.

<Definition of the surface silicon content (Si/C) of carbon fibers measured by X-ray photoelectron spectroscopy (ESCA)>

The surface silicon content Si/C of carbon fibers is measured by ESCA as described below. First of all, the carbon fibers to be measured should have no sizing agent, etc. on the surfaces. If a sizing agent, etc. are sized, they should be removed by refluxing by a Soxhlet extractor using dimethylformamide for 2 hours. Then, the surface silicon content Si/C is measured under the following conditions. As the excitation X-ray, $K\alpha_{1,2}$ ray of Mg is used, and the binding energy value of $C_{1S}$ main peak is set at 284.6 eV, to obtain the peak area ratio to $Si_{2P}$ observed near 100 eV. In the examples described later, ESCA750 produced by Shimadzu Corp. was used, and the measured value was multiplied by an instrument constant of 0.814, to obtain the atomic ratio of Si/C. The value is adopted as surface silicon content Si/C.

<Size and orientation degree of graphite crystals of carbon fibers obtained by X-ray diffraction>

It is preferable that the size and orientation degree of graphite crystals obtained by X-ray diffraction are 10 to 40 Å and 75 to 98% respectively, and more preferable are 12 to 20 Å and 80 to 95% respectively. It is also preferable that the quantity of micro-voids is small, and that the X-ray small angle scattering intensity at 1 degree is 1,000 cps or less.

<Difference in crystallinity between the inner and outer layers of each single filament of carbon fibers>

It is preferable for obtaining a high strength that the difference in crystallinity between the inner and outer layers of each single filament of carbon fibers is small. It is preferable that the carbon fibers of the present invention are 0.7 time to 1.3 times in the ratio of the half value width of 002 diffraction peak of the outer layer obtained by selected-area electron diffraction to that of the inner layer, and 0.7 to 1.5 times in the ratio of the orientation degree of the outer layer to that of the inner layer. If the difference in crystallinity between the inner and outer layers is small like this, the stress concentration at the outer layer with a high defect existence probability can be inhibited.

<Nitrogen content of single filaments of carbon fibers>

It is preferable that the carbon fibers of the present invention are 1 wt % to 10 wt % in the nitrogen content of single filaments. A more preferable range is 3 wt % to 6 wt %.

<Stabilization inhibitor content of carbon fibers>

The carbon fibers of the present invention can be obtained by carbonizing the acrylic fibers (precursor fibers) containing a stabilization inhibitor described later. Therefore, the carbon fibers of the present invention contain a stabilization inhibitor, specifically 0.01 to 5 wt % of a stabilization inhibitor. A preferable stabilization inhibitor is boron, and in this case, it is preferable that the stabilization inhibitor content is 0.03 to 3 wt %, and a more preferable range is 0.05 to 2 wt %. The stabilization inhibitor distribution in each single filament can be measured by SIMS, and if the content ratio of the outer layer to the inner layer is DDR, it is preferable to satisfy $5 \leqq DDR \leqq 1{,}000$.

<Relation between the specific gravity (ρ) and strength (σ) of carbon fibers>

The strength of carbon fibers containing a stabilization inhibitor is higher than that of conventional fibers with the same specific gravity, and the difference in specific strength is also remarkable.

It is preferable that the carbon fibers of the present invention have a single filament diameter of 6 μm or more, and satisfy the following relation between specific gravity ρ and strength σ (GPa).

Where specific gravity ρ is 1.7875 or less:

$$\sigma \geqq 5.20 \quad \text{(d-1)}$$

Where specific gravity ρ exceeds 1.7875, $$\sigma \geqq 4.4800\times10^3\rho^2 - 1.6016\times10^4\rho + 1.43195\times10^4 \quad \text{(d-2)}$$

No conventional carbon fibers satisfy this range. It is more preferable for obtaining carbon fibers with a higher specific strength, that the following relation is satisfied:

Where specific gravity ρ is 1.7875 or less:

$$\sigma \geqq 5.50 \quad \text{(d-3)}$$

Where specific gravity ρ exceeds 1.7875, $$\sigma \geqq 4.4800\times10^3\rho^2 - 1.43198\times10^4\rho + 1.600\times10^4 \quad \text{(d-4)}$$

<Denseness and oxygen permeability of acrylic fibers (precursor fibers)>

The acrylic fibers (precursor fibers) of the present invention are characterized by being dense in the outer layer of each single filament and excellent in oxygen permeability, and having silicone compounds with a crosslinking ratio of 10% or more in the outer layer.

If the outer layer is dense, the penetration of the oil into the outer layer of each single filament in the spinning and drawing process can be prevented, and hence, the production of micro-voids in the outer layer of each single filament after carbonization caused by the penetration of the oil can be inhibited. As an indicator of the denseness, the difference in lightness ΔL before and after iodine adsorption must be 5 to 42, and a preferable range is 5 to 30.

The denseness can be known by observing the cross section of each single filament by a transmission electron microscope, and also in reference to the existence of micro-voids in the outer layer. The outer layer in this case refers to the region from the surface to ⅕ or less of the radius of the single filament. A micro-void refers to a void which can be observed on a TEM photograph taken at 100,000 times, and has a width of about 0.005 to 0.02 nm. Usually mirco-voids often exist in stripes along the fiber axis direction almost in parallel to the fiber surface concentrically in a region of 10 to 1000 nm from the fiber surface, and the existence ratio is 5 to 30% in a region from the surface to 50 nm in the case of conventional acrylic fibers (precursor fibers) to be processed into carbon fibers. In the acrylic fibers (precursor fibers) of the present invention, it is preferable that the ratio is 5% or less. Preferable is 3% or less, further more preferable is 1% or less. Especially preferable is 0.5% or less.

To obtain the ratio, several very thin cross sections of single filaments of acrylic fibers (precursor fibers) are prepared by a microtome and photographed at 100,000 times using a transmission electron microscope, and the ratio of the void area observed in each photograph to the area down to a depth of 50 nm is calculated. The average value of the calculated ratios is adopted as the ratio.

It is preferable that the specific gravity of acrylic fibers (precursor fibers) as another indicator of denseness is 1.170 or more, and more preferable is 1.175 or more. The conventional acrylic fibers (precursor fibers) to be processed into carbon fibers have a specific gravity of about 1.168, and on the contrary the acrylic fibers (precursor fibers) of the present invention have a specific gravity in a range of 1.170 to 1.178, and a preferable range is 1.175 to 1.178.

If the denseness is improved as described above, dense precursor fibers free from micro-voids in the outer layer of each single filament can be obtained. However, if the denseness is higher, the oxygen permeability into the inner layer in the stabilization process becomes lower, causing the inner layer to be insufficiently stabilized, thus enlarging the structural difference between the inner and outer layers of the obtained carbon fibers. As a result, such problems that the strength declines, that the modulus declines and that fiber breakage occurs in the carbonization process are caused.

That is, since the modulus of the outer layer of each single filament is higher than that of the inner layer, a certain tensile strain loaded causes its stress to be concentrated at the outer layer, and the stress concentration on a defect existing in the surface or outer layer causes the single filament to be fractured even at a low stress. Such carbon fibers are low in critical stress intensity factor and also low in strength.

Therefore, if the denseness of the precursor fibers is higher, the promotion of oxygen permeation into the precursor fibers is important for improving the strength of the carbon fibers obtained.

Indicator of oxygen permeability: Precursor fibers are stabilized at 250° C. for 15 minutes and at 270° C. for 15 minutes in an air oven of atmospheric pressure, to prepare stabilized fibers. Then, the oxygen content distribution in the depth direction in each single filament of the stabilized fibers is obtained by secondary ion mass spectrometry (SIMS). The ratio of the oxygen content of the inner layer to that of the outer layer in each single filament obtained in this case is used as the indicator of the oxygen permeability. It is important that the ratio of the oxygen content of the inner layer to that of the outer layer is larger than ⅙. It is preferable that the oxygen content ratio is ⅓ or more, and more preferable is ¼ or more. If such precursor fibers are used, carbon fibers of the present invention with a high strength even if the single filament fineness is large can be obtained.

In this case, the oxygen content of the outer layer of each single filament means the O/C at a depth of 2.5% of the diameter of the single filament from the surface, and the oxygen content of the inner layer means the O/C at a depth of 40% of the diameter of the single filament from the surface.

The precursor fibers of the present invention have a high denseness and a high oxygen permeability as described above, and also contain silicone compounds with a crosslinking ratio of 10% or more in the outer layer of each single filament. If such silicone compounds are contained in the outer layer, carbon fibers with very little coalescence between single filaments and with few surface macro-defects can be obtained.

The silicone compounds have siloxane bonds as their basic skeleton, and it is preferable that the group combined at each silicon atom is a hydrogen atom, alkyl group with 1 to 3 carbon atoms, phenyl group or any of their alkoxy groups. Among them, especially dimethylsiloxane is preferable.

Furthermore, it is preferable to use an amino-modified silicone compound, epoxy-modified silicone compound or alkylene-oxide-modified silicone compound of dimethylsiloxane, or any of their mixtures.

In the present invention, it is preferable that the crosslinking ratios (CL) of the silicone compounds are 10% or more. If the crosslinking ratios are high, the silicones have a high effect of inhibiting the coalescence between single filaments, hence a high effect of improving the strength of the carbon fibers obtained. It is more preferable that the crosslinking ratios (CL) of the silicones are 20% or more. More preferable is 30% or more, and further more preferable is 50% or more.

In the present invention, the crosslinking ratio (CL) of a silicone is measured as described below. At first, under the following conditions, silicon is colored by ammonium molybdate, to measure the silicone content SO(%). Wavelength: 420 nm, Instrument: Spectrophotometer UV-160 produced by Shimadzu Corp., Sample preparation conditions: Precursor fibers are cut at about 10 mm, and about 0.1 g of them are accurately weighed and put into a pressure decomposition reactor made of teflon which is then stoppered. The fibers in the reactor are heated at 150° C. for 3 hours for decomposition, and cooled to room temperature. All the content is put onto a platinum dish, evaporated to dryness, ignited to be molten, and allowed to cool. As a blank, 10 ml of 10 wt % sodium hydroxide aqueous solution is taken on a platinum dish, evaporated to dry, ignited to be molten, and allowed to cool. About 20 ml of pure water is added, and the mixture is heated to be dissolved and allowed to cool. Then, about 4.5 ml of 17.5 wt % hydrochloric acid is added, and the mixture is filtered. The filtrate is washed with pure water, till its amount becomes 90 ml, and its pH is adjusted to 1.2~1.5 by 17.5 wt % hydrochloric acid. With stirring, 2 ml of 10 wt % ammonium molybdate aqueous solution is added, and the mixture is allowed to stand for 10 minutes. Furthermore, 2 ml of 10 wt % tartaric acid aqueous solution is added, and 100 ml of the mixture is taken into a measuring flask, to measure the absorbance.

Then, a silicone emulsion with a known concentration is used, to prepare samples as described above for silicone amounts of 0.15, 0.3, 0.45 and $0.6\times10^{-3}$ g. Their absorbances are measured, and a calibration curve (y=Kx) is prepared according to the least square method. From the curve, coefficient K is obtained, and the sized amount of silicone So (%) is calculated from the following formula:

$$So=[(I_S-I_B)\times K/W_S]\times100 \quad \text{(e-1)}$$

where $I_S$ and $I_B$ are the absorbances of the sample and the blank respectively, and WS is the weight (g) of the precursor.

Subsequently, the precursor is accurately weighed, and a Soxhlet extractor is used for refluxing in toluene for 1 hour, to extract non-crosslinked silicone, and the insoluble matter is secured by filtration and dried at 120° C. for 2 hours, to obtain non-crosslinked silicone. From the following formula, the sized amount of the non-crosslinked silicone Si (%) is calculated.

$$S_1=(W_P/W_L)\times100 \quad \text{(e-2)}$$

where $W_P$ and $W_L$ are the weights (g) of the precursor and the non-crosslinked silicone.

Then, from the following formula, the crosslinking ratio CL (%) of the silicone is calculated.

$$CL=[1-S_1/S_0]\times100 \quad \text{(e-3)}$$

Furthermore, in the present invention, it is preferable that the precursor fibers are covered on their surfaces with silicones as much as possible. If silicones are assumed to be uniformly sized, mainly the silicones only are detected, considering the detectable depth of ESCA. Therefore, from the measured value of Si/C, the covering ratio CSi/C (%) can be obtained by calculation according to the following method. In the case of polyacrylonitrile based precursor fibers, since the N/C in the polymer of the precursor fibers is known, the covering ratio CN/C (%) can also be calculated from the value of N/C, applying that the silicone contains little nitrogen.

Measuring method: Instrument: ESCA750 produced by Shimadzu Corp., Exciting X-ray: Mg $K\alpha_{1,2}$ ray, Energy correction: The binding energy value of $C_{IS}$ main peak is set at 284.6 eV, and Sensitivity correction value: 1.7 (N/C), 0.814 (Si/C).

$$CSi/C=[(Si/C)/(½)]\times100 \quad \text{(f-1)}$$

$$CN/C=[1-\{(N/C)/(⅓)\}]\times100 \quad \text{(f-2)}$$

If the value of CSi/C or CN/C is more than 100 due to an experimental error, 100 should be adopted, and if less than 0, 0 should be adopted. If the covering ratio is higher, the effect of improving the strength is higher. So, it is preferable that the value of CSi/C or CN/C is 50% or more. More preferable is 70% or more, and further more preferable is 90% or more.

<Definition of the difference in lightness due to iodine adsorption of acrylic fibers (precursor fibers) (ΔL)>

The difference in lightness (ΔL) due to iodine adsorption is measured as described below. Dried precursor fibers are cut at a length of about 6 cm, opened by a hand card and accurately weighed, to prepare 0.5 g each of two samples. One of the samples is put in a 200 ml Erlenmeyer flask with a polished stopper, and 100 ml of an iodine solution (obtained by weighing 50.76 g of iodine, 10 g of 2,4-dichlorophenol, 90 g of acetic acid and 100 g of potassium iodide respectively, putting them into a 1-liter measuring flask, and dissolving the mixture by water to make 1,000 ml) is added into the flask. The mixture is shaken at 60±0.5° C. for 50 minutes, for adsorption treatment.

The sample with iodine adsorbed is washed in running water for 30 minutes and centrifuged for dehydration. The dehydrated sample is dried in air for 2 hours, and opened again by a hand card.

The samples with and without iodine adsorbed are paralleled in fiber direction, and their L values are measured by a color difference meter simultaneously. With the L value of the sample without iodine adsorbed as L1 and that of the sample with iodine adsorbed as L2, the difference of L values (L1−L2) is adopted as the difference in lightness (ΔL) due to iodine adsorption. The oxygen content ratio by SIMS is obtained by stabilizing precursor fibers under predetermined conditions, aligning the stabilized fibers as bundles, irradiating them with primary ions in vacuum from a side of them, and measuring the secondary ions produced by the irradiation under the following conditions. Instrument: A-DIDA3000 produced by Atomika, Germany, Primary ion species: $Cs^+$, Primary ion energy: 12 keV, Primary ion current: 100 nA, Raster range: 250×250 μm, Gate rate: 30%, Analyzed range: 75×75 μm, Detected secondary ions: Positive ions, Electron spray conditions: 0.6 kV–3.0 A (F7.5), Vacuum degree during measurement: $1\times10^{-8}$ Torr, and H-Q-H: #14.

It is preferable that the precursor fibers have a strength of 0.06 to 0.2 N/d and an elongation of 8 to 15%. It is more preferable that the strength is 0.07 to 0.2 N/d and that the elongation is 10 to 15%.

It is also preferable that the crystal orientation degree π400 in the fiber axis direction of the precursor fibers accounts for 80 to 95%, and a more preferable range is 90 to 95%.

The crystallite orientation degree π400 in the fiber axis direction is obtained according to the following method. A sample of about 20 mg/4 cm is fixed by collodion in a 1 mm wide mold, for measurement. As the X-ray source, the Kα ray (wavelength: 1.5418 Å) of Cu made monochromatic by a Ni filter is used, and measurement is effected at an output of 35 kV and 15 mA. The half width H (°) of the peak obtained by meridionally scanning the peak of the index of a plane (400) observed near 2θ=17° is substituted into the following formula:

$$\pi400(\%)=(180-H)\times100/180 \quad \text{(g-1)}$$

The used goniometer has a slit diameter of 2 mm, and the used counter is a scintillation counter. The scanning speed is 4°/min, and the time constant is 1 second. The chart speed is 1 cm/min.

<Processes for producing acrylic fibers (precursor fibers) and carbon fibers of the present invention>

The processes for producing acrylic fibers (precursor fibers) and carbon fibers of the present invention are described below.

The process for producing precursor fibers of the present invention comprises the steps of using an acrylic polymer consisting of 90 mol % or more of acrylonitrile, and a densifying accelerator and a drawing promoter respectively acting in the spinning and drawing process, and a stabilization accelerator and an oxygen permeation promoter respectively acting in the stabilization process, as a raw material; wet-spinning or dry jet spinning it; drawing the obtained fibers in water of 60° C. or higher, to obtain precursor fibers with a swelling degree of 100% or less; applying an oil consisting of silicone compounds and crosslinking accelerator, to the obtained fibers, by 0.01 wt % to 5 wt %; and as required, drawing in a high temperature heat carrier such as steam.

It is preferable that the silicone compounds are an amino-modified silicone compound and an epoxy-modified silicone compound. It is also preferable to contain the fine particles described later. The process is described below in more detail.

To obtain excellent carbon fibers, the polymer composition is important.

It is important that the components to be copolymerized for obtaining the polymer are a densifying accelerator and a drawing promoter respectively required in the spinning and drawing process and a stabilization accelerator and an oxygen permeation promoter respectively required in the stabilization process.

The components important for improving the strength of carbon fibers are a densifying accelerator and an oxygen permeation promoter. Densification is effective for inhibiting the production of micro-voids in the outer layer. The improvement of oxygen permeability is effective for narrowing the modulus distribution in each single filament, to inhibit the stress concentration on any defect in the surface or outer layer. When the carbon fibers as thick as 6 $\mu$m or more in single filament diameter or when the outer layer of each single filament is highly densified, oxygen permeability is especially important.

The stabilization accelerator is necessary to complete stabilization in a short time, and absolutely necessary for reducing the heat treatment cost. The drawing promoter is important for improving the productivity in the spinning and drawing process, and important for reducing the cost of precursor fibers. Especially since some oxygen permeation promoters act to lower the spinning and drawing processability when they are copolymerized to make the raw polymer, it is very important to copolymerize a drawing promoter for preventing it.

Preferable stabilization accelerators which can be used here are unsaturated carboxylic acids, for example, acrylic acid, methacrylic acid, itaconic acid, crotonic acid, citraconic acid, ethacrylic acid, maleic acid, mesaconic acid, etc. Especially acrylic acid, methacrylic acid and itaconic acid are preferable. As for the amount of it to be copolymerized, 0.1 to 5 wt % is preferable.

It is important that the densifying accelerator is effective for improving the hydrophilicity of the polymer. A preferable densifying accelerator is a vinyl compound with a hydrophilic functional group such as a carboxyl group, sulfo groups amino group or amido group. The densifying accelerators respectively with a carboxyl group which can be used here include, for example, acrylic acid, methacrylic acid, itaconic acid, crotonic acid, citraconic acid, ethacrylic acid, maleic acid, mesaconic acid, etc. Especially acrylic acid, methacrylic acid and itaconic acid are preferable. The densifying accelerators respectively with a sulfo group which can be used here include, for example, allylsulfonic acid, methallylsulfonic acid, styrenesulfonic acid, 2-acrylamido-2-methylpropanesulfonic acid, vinylsulfonic acid, sulfopropyl methacrylate, etc. Especially allylsulfonic acid, methallylsulfonic acid, styrenesulfonic acid and 2-acrylamido-2-methylpropanesulfonic acid are preferable. The densifying accelerators respectively with an amino group which can be used here include, for example, dimethylaminoethyl methacrylate, diethylaminoethyl methacrylate, dimethylaminoethyl acrylate, diethylaminoethyl acrylate, tertiary butylaminoethyl methacrylate, allylamine, o-aminostyrene, p-aminostyrene, etc. Especially dimethylaminoethyl methacrylate, diethylaminoethyl methacrylate, dimethylaminoethyl acrylate and diethylaminoethyl acrylate are preferable. The densifying accelerators respectively with an amido group which can be used here include, for example, acrylamide, methacrylamide, dimethylacrylamide, crotonamide, etc.

Furthermore, it is also preferable to neutralize carboxyl groups, sulfo groups or amino groups, etc. by a base or acid, etc. for improving hydrophilicity before or after polymerization. This improves the hydrophilicity of the polymer and greatly improves densification. As for the amount neutralized, all can be neutralized or only a minimum amount required for hydrophilicity can be neutralized. The bases and acids which can be used in this case include ammonia, amine compounds, sodium hydroxide, hydrochloric acid, etc.

If an amine with a molecular weight of 60 or more is used as an amine for neutralization, the oxygen permeability can also be simultaneously improved. Amines with a molecular weight of 60 or more include monoalkylamines such as octylamine, dodecylamine and laurylamine, dialkylamines such as dioctylamine, trialkylamines such as trioctylamine, diamines such as ethylenediamine and hexamethylenediamine, polyethylene glycol esters and polypropylene glycol esters of octylamine, laurylamine and dodecylamine and of polyethylene glycol esters and polypropylene glycol esters and diamines and triamines. Among them, amines which are soluble in the polymerization solvent or medium or spinning solvent are preferable, and monoalkylamines, diamines, polyethylene glycol esters and polypropylene glycol esters of octylamine, laurylamine and dodecylamine, and polyethylene glycol esters and polypropylene glycol esters of diamines and triamines are preferable.

It is preferable to optimize the composition in view of the balance between the densifying effect and the cost. Considering the cost of the neutralizing compound and handling convenience, ammonia is preferable. That is, since carboxylic acids such as acrylic acid, methacrylic acid and itaconic acid can accelerate densification as described before, neutralizing a carboxylic acid partially or wholly by ammonia can provide the capability to accelerate densification. That is, in general, it is preferable to use a vinyl compound with a carboxyl group as the densifying accelerator, and to neutralize it after polymerization partially or wholly by ammonia. It is preferable that the copolymerized amount is 0.1 to 5 wt %.

It is important that the drawing promoter acts to lower the glass transition point of the polymer. From this point of view, in general, a monomer with a large molecular weight is preferable, and to enhance the degree of freedom of copolymerization design, a monomer which does not extremely accelerate or inhibit the stabilization reaction is preferable. Furthermore, from the viewpoint of reactivity, methyl acrylate, ethyl acrylate, methyl methacrylate, ethyl methacrylate and vinyl acetate are preferable, and above all, methyl acrylate is preferable.

Preferable oxygen permeation promoters which can be used here are polymerizable unsaturated carboxylates. Especially esters with a bulky side chain such as normal propyl esters, normal butyl ester, isobutyl esters, secondary butyl esters, and esters of alkyls with 5 or more carbon atoms are preferable.

They include, for example, normal propyl acrylate, normal butyl methacrylate, isobutyl methacrylate, isobutyl itaconate, lauryl ethacrylate, stearyl acrylate, cyclohexyl methacrylate and diethylaminoethyl methacrylate, etc. Especially acrylates, methacrylates and itaconates are preferable, and isopropyl esters, normal butyl esters and isobutyl esters are more preferable. Even an ester with a small side chain such as a methyl ester has oxygen permeation effect, but to obtain the same oxygen permeability as obtained by an ester with a bulky side chain, a more amount must be copolymerized. It is preferable that the copolymerized amount is 0.1 to 5 wt %.

As the molar ratio of the densifying accelerator, the drawing promoter, the stabilization accelerator and the oxygen permeation promoter, 1:(0.1~10):(0.1~10):(0.1~10) is preferable, and 1:(0.5~5):(1~7):(1~5) is more preferable. A ratio of 1:(0.5~2):(1~5):(1~3) is further more preferable.

As each of the densifying accelerator, drawing promoter, stabilization accelerator and oxygen permeation promoter, two or more components can be used together to achieve the intended effect. However, on the contrary, if one component can provide two or more intended effects, the one component can be used to achieve the two or more intended effects, instead of using two or more components for the respectively intended effects. A smaller number of components is preferable since the cost is lower.

For example as described before, if both the densifying acceleration and the stabilization promotion can be achieved by one unsaturated carboxylic acid such as itaconic acid, acrylic acid or methacrylic acid, and the carboxyl groups are partially or wholly neutralized by ammonia, then the hydrophilicity can be improved, thereby improving the densification. Furthermore, both the drawing acceleration and the oxygen permeation promotion can be achieved by one unsaturated carboxylate such as methyl acrylate or ethyl acrylate. Moreover, the oxygen permeation promotion and the densifying acceleration can also be achieved by one aminoalkyl unsaturated carboxylate such as diethylaminoethyl methacrylate.

It can happen that the monomer cost becomes low even if the number of components is large. So, it is preferable to decide the components in view of the balance between the final carbon fiber production cost and mechanical properties. Furthermore, it is also allowed to copolymerize an unsaturated monomer copolymerizable with acrylonitrile in addition to said four components, as far as the cost warrants it.

As for the amount of the components to be copolymerized, it is preferable that the total amount of other copolymerized components than acrylonitrile is 1 to 10 wt %. A total amount of 2 to 6 wt % is more preferable, and 3 to 5 wt % is further more preferable. If the total amount of the copolymerized components exceeds 10 wt %, heat resistance declines and the coalescence between single filaments may occur in the stabilization process. If less than 1 wt %, the intended effects may be insufficient.

A higher polymerization degree is more effective in improving the tensile strength and elongation of the precursor fibers under the same spinning and drawing conditions, but lowers the spinning and drawing processability since the viscosity of the polymer rises and since the spinning and drawing processability declines. So, it is preferable to decide the polymerization degree, considering their balance. Specifically, it is preferable that the intrinsic viscosity is 1.0 to 3.0. An intrinsic viscosity of 1.3 to 2.5 is more preferable, and 1.5 to 2.0 is further more preferable. If the polymerization degree is low, the spinning and drawing processability improves, but since heat resistance declines, the coalescence between single filaments is likely to occur in the spinning and drawing process and the carbonization process.

A more narrow molecular weight distribution assures more excellent drawability in the spinning and drawing process and improves the strength of obtained carbon fibers. So, it is preferable to sharpen the molecular weight distribution. Specifically it is preferable that the ratio of weight average molecular weight Mw to number average molecular weight Mn; Mw/Mn is 3.5 or less, and a ratio of 2.5 or less is more preferable. To sharpen the molecular weight distribution, it is effective that monomers are added sequentially in the polymerization process, instead of being added at a time before start of polymerization. For the sequential addition, it is preferable to calculate the monomer reaction rate, for deciding the monomers added and adding rates to keep the produced polymer composition constant in the polymerization process.

For polymerization, any conventional polymerization method such as solution polymerization, suspension polymerization or emulsification polymerization can be applied.

If the concentration of the polymer supplied for spinning is higher, the amount replaced by a solvent and a precipitant during coagulation becomes less to allow denser precursor fibers to be obtained, and this is effective for enhancing the strength of carbon fibers. However, on the other hand, the spinning and drawing processability declines due to higher polymer dope viscosity, higher likeliness to cause gelation and lower spinnability and drawability. So, it is preferable to decide the concentration, considering the balance. Specifically it is preferable that the polymer concentration is 10 to 30 wt %, and a concentration of 15 to 25 wt % is more preferable.

The spinning method can be melt spinning, wet spinning, dry spinning or dry jet spinning, etc. Among them, wet spinning or dry jet spinning is preferable since densification is easier and since fibers with a higher strength can be easily obtained. Especially dry jet spinning is preferable.

The solvents which can be used include conventionally known ones such as dimethyl sulfoxide, dimethylformamide, dimethylacetamide, sodium thiocyanate and zinc chloride. In view of productivity, dimethyl sulfoxide, dimethylformamide or dimethylacetamide is preferable since they are high in coagulation. Dimethyl sulfoxide is especially preferable.

The coagulation conditions also greatly affect the structures and tensile properties of the precursor fibers and carbon fibers. So, it is preferable to decide the conditions in reference to both tensile properties and productivity. Especially to obtain dense coagulated fibers with less voids, a lower coagulation rate is preferable, and hence it is preferable to coagulate at a low temperature at a high concentration.

It is preferable that the temperature of the spinning dope is 60° C. or lower. More preferable is 50° C. or lower, and further more preferable is 40° C. or lower. It is preferable that the temperature of the coagulating bath is 20° C. or lower, and more preferable is 10° C. or lower. Further more preferable is 5° C. or lower.

It is preferable that the swelling degree of coagulated fibers is 100 to 300%. A more preferable range is 150 to 250%, and a further more preferable range is 150 to 200%. If the coagulated fibers are too dense, fiber drawability declines, and the precursor fibers obtained are likely to cause nonuniformity in stabilization degree in single filaments in the stabilization process.

It is preferable that the fibril diameter of coagulated fibers is thinner, and if they are thinner, they can be more easily densified in the subsequent drawing in baths. The fibril diameter in this case can be observed with TEM. It is preferable that the diameter is 100 to 600 Å. A more preferable range is 100 to 400 Å, and a further more preferable range is 100 to 300 Å.

The fibril diameter is obtained by freeze-drying coagulated fibers, preparing a longitudinal section by a microtome, photographing it at 50,000 times using a transmission electron microscope, and measuring the fibril diameters in a region of 0.5 to 1.0 $\mu$m from the surface. The coagulated fibers have a spongy structure, and contain thick portions with fibrils bonded. Measurement is made at 10 places where each fibril can be observed independently, and the average value is obtained.

As a spinneret, usually a spinneret with circular holes is used to obtain coagulated fibers with a circular or similar cross sectional form, but coagulated fibers with a cross sectional form other than a circle such as triangle, square or pentagon can be obtained by combining a plurality of filaments obtained from a set of slits or small circular holes.

After completion of coagulation, washing with water and drawing are carried out, and as required, acid treatment, etc. are also carried out. Especially the temperature of drawing is important for accelerating densification. It is important that the highest temperature of drawing in baths is 60 to 100° C. A preferable range is 70 to 100° C., and an especially preferable range is 80 to 100° C.

It is preferable that the drawing is carried out in two or more baths, since the strength can be improved. It is also preferable that a temperature profile from a low temperature to a high temperature is formed across the baths and that the temperature difference between the adjacent baths is kept at 20° C. or less, since the coalescence between single filaments can be inhibited.

It is preferable that the total drawing ratio of drawing in baths is 1.5 to 8 times, and a more preferable range is 2 to 5 times.

In a drawing bath with a high temperature, the inlet roller is liable to cause thermal stress coalescence between single filaments. So, it is effective to install the roller outside the high temperature bath. Furthermore, to disengage the pseudo-coalescence, it is effective to install a vibration guide in a bath, for vibrating the fiber bundle. It is preferable that the vibration frequency in this case is 5 to 100 Hz, and that the amplitude is 0.1 to 10 mm. If these techniques are integrated, drawing in baths with a high temperature of 60 to 100° C. can be easily effected even in the dry jet spinning method.

It is preferable that the ratio of the swelling degree (BY) of the drawn fibers to the swelling degree (BG) of the coagulated fibers, i.e., BY/BG is smaller. A ratio range of 0.1 to 0.5 is preferable, and a range of 0.2 to 0.45 is more preferable. If the coagulating conditions, drawing conditions and polymer composition are combined like this, bath-drawn fibers with a swelling degree of 100% or less can be obtained. To produce carbon fibers with a higher strength, it is necessary to obtain denser precursor fibers. In this case, it is preferable that the swelling degree of drawn fibers is 90% or less, and more preferable is 80% or less. It is preferable that the lower limit is 40% or more in view of oxygen permeability in the stabilization process, and more preferable is 50% or more.

The fibril diameter of bath-drawn fibers can also be measured using a transmission electron microscope as described for the coagulated fibers. It is preferable that the fibril diameter is 50 to 200 Å, and a more preferable range is 50 to 150 Å.

The swelling degree is obtained according to the following method. Swelling fibers get their free water removed by a centrifugal dehydrator at 3000 rpm for 15 minutes, and are weighed as weight w. They are dried by a hot air dryer at 110° C. for 2 hours, and weighed as weight wO. The swelling degree is obtained from the following formula:

$$\text{Swelling degree } (\%)=(w-w0)\times 100/w0 \quad \text{(h-1)}$$

As excellent precursor fibers to be processed into carbon fibers, it is important that the coalescence between single filaments is less and that the coalescence between single filaments does not occur in the carbonization process either. For this purpose, it is important to apply an excellent oil uniformly.

Especially when the amount of copolymerized components is large to promote densification and oxygen permeability, etc., the melting point of the polymer declines and the coalescence is liable to occur. So, if the amount of copolymerized components is larger, the performance of the oil more greatly affects the strength and elongation characteristics of carbon fibers.

A preferable oil means an oil which can be uniformly applied to filaments, is high in heat resistance, can prevent the coalescence between single filaments in the carbonization process, and is less transferred to rollers, etc. in the drying process, hence excellent in processability.

The oils which can be used here include silicone compounds, higher alcohols, higher fatty acid esters, etc. and their mixed oils. However, it is important that a silicone compound high in the effect of inhibiting the coalescence between single filaments is contained.

It is preferable that the silicone compound is dimethylsiloxane as described before. In view of processability, a water soluble silicone compound or self-emulsifiable silicon compound to allow use in an aqueous system or a silicone compound which can be emulsified by a nonionic surfactant, to form a stable emulsion is preferable.

Moreover, as described before, it is preferable to use a modified silicone compound such as an amino-modified, epoxy-modified or alkylene-oxide-modified silicone compound of dimethylsiloxane or any of their mixtures. Especially it is preferable to contain an amino-modified silicone compound, and it is important to contain both an amino-modified silicone compound and an epoxy-modified silicone compound. It is more preferable to contain an amino-modified silicone compound, epoxy-modified silicone compound and alkylene-oxide-modified silicone compound. In this case, it is preferable that the mixing ratio of amino-modified silicone compound:epoxy-modified silicone compound:alkylene-oxide-modified silicone compound is 1:0.1~5:0.1~5. A more preferable ratio is 1:0.5~2:0.2~1.5.

It is preferable that the amino-modified amount is 0.05 to 10 wt % with end amino groups as —$NH_2$ groups. A more preferable range is 0.1 to 5 wt %. It is preferable that the epoxy-modified amount is 0.05 to 10 wt % as the weight of epoxy groups —$CHCH_2O$. A more preferable range is 0.1 to 5 wt %. It is preferable that the alkylene-oxide-modified amount is 10 to 80 wt % as the alkylene-oxide-modified portion. A more preferable range is 15 to 60 wt %.

It is preferable that the amount of the silicone compound sized is 0.01 to 5 wt % based on the weight of dry filaments. A more preferable range is 0.05 to 3 wt %, and a further more preferable range is 0.1 to 1.5 wt %. A smaller amount of the oil sized is advantageous for decreasing the tar and exhaust gas in the carbonization process. So, it is effective for reducing the cost that the amount is kept low as far as the coalescence between single filaments can be inhibited. However, if the amount of the oil sized is less than 0.01 wt %, the uniform sizing on the surface of the fiber bundles becomes difficult. To size the oil uniformly, it is effective to pass the precursor fibers through a zigzag passage with a plurality of free rollers arranged to provide a total contact angle of 8π or more, after oiling. It is preferable that the contact angle is larger, and in view of cost or space, 16p or less is practical.

In this case, it is effective to add water or an oil to precursor fibers as a lubricant by spraying or dropwise addition, etc. before the precursor fibers go into the area of rollers. It promotes the uniform diffusion of the oil into the fiber bundles and allows uniform sizing of the oil by a smaller amount. Furthermore, it is effective for uniform sizing of the oil onto the fibers, to promote the migration of the oil from single filaments to single filaments within fiber bundles by ultrasonic vibration in an oil bath or oblique zigzag rollers.

As for the heat resistance of the oil, it is preferable that the residue rate (r) of the oil after heat treatment in air and nitrogen is 20% or more. More preferable is 30% or more, and a further more preferable is 40% or more. It is preferable that the upper limit of the residue rate after heat treatment is 100%, but the practical upper limit is up to 95%.

The residue rate (r) after heat treatment refers to the remaining rate of a silicone after heat-treating it in air of 240° C. for 60 minutes and subsequently heat-treating in nitrogen of 450° C. for 30 seconds. The measuring procedure is as follows.

If the silicone applied is an emulsion or solution, about 1 g of it is taken in an aluminum container with a diameter of about 60 mm and a height of about 20 mm and dried in an oven at 105° C. for 5 hours, to obtain the silicone, and the residue rate of it after heat treatment is measured by a thermogravitometry (TG) under the following conditions. Sample pan: an aluminum pan with a diameter of 5 mm and a height of 5 mm, Amount of sample: 15~20 mg, Heat treatment conditions in air: at an air flow rate of 30 ml/min, temperature raised at a rate of 10° C./min, and heat-treated at 240° C. for 60 minutes, Change of atmosphere: atmosphere changed from air to nitrogen at 240° C. and kept for 5 minutes, and Heat treatment conditions in nitrogen: at nitrogen flow rate of 30 ml/min, temperature raised at a rate of 10° C./min, and heat-treated at 450° C. for 30 seconds. The total weight holding rate in this heat treatment is adopted as the residue rate after heat treatment.

If the residue rate after heat treatment is high like this, the coalescence between single filaments in the stabilization process and in the beginning of the carbonization process can be prevented. To improve the residue rate after heat treatment, it is effective to mix the above modified silicone compounds at a predetermined ratio and to use compounds higher in molecular weight as the oil components. Specifically it is preferable that the viscosities of the respective oil components at 25° C. are 300 cSt or more. More preferable is 1000 cSt or more, and further more preferable is 2000 cSt or more. Especially preferable is 3000 cSt or more. A preferable upper limit of the viscosities is 20,000 cSt or less in view of the handling convenience and uniform sizability due to solubility, etc.

The optimum value of the kinetic viscosity is different, depending on the kind of modifying groups. The preferable optimum viscosities of the amino-modified silicone oil, epoxy-modified silicone oil and alkylene-oxide-modified silicone oil at 25° C. are respectively (a) 100~100,000 cSt, 100~100,000 cSt and 10~10,000 cSt. More preferable are (b) 1,000~50,000 cSt, 1,000~50,000 cSt and 500~5,000 cSt, and further more preferable are (c) 2,000~30,000 cSt, 2,000~30,000 cSt and 1,000~5,000 cSt. A higher kinetic viscosity is advantageous in view of heat resistance, but it must be noted that if the kinetic viscosity is too high, the stability of the oil, uniform depositability, etc. may decline.

It has been known that an oil excellent in heat resistance is effective for enhancing the strength of carbon fibers, but the effect is not so high as achieved in the present invention. In addition, there has been a problem that the amount of the oil transferred onto the rollers in the drying and densifying process, etc. increases, making long-time stable operation of the process difficult. To solve the problem, various methods such as the use of a continuous roller wiper have been applied, but these measures do not solve the conventional problem essentially. In the present invention, as a preferable measure for solving the problem, it has been found effective to add a crosslinking accelerator to the oil.

As the crosslinking accelerator, an ammonium compound or acid is preferable. The ammonium compounds which can be used here include ammonium carbonate, ammonium hydrogencarbonate, ammonium phosphate, etc., and the acids which can be used here include itaconic acid, phosphoric acid and boric acid. Especially ammonium carbonate, ammonium hydrogencarbonate and boric acid are preferable since they are effective in improving physical properties and decreasing gum-up, and safe. It is preferable that the amount of the ammonium compound or acid added is 0.01 to 10 wt % based on the weight of the silicone compounds, and a more preferable range is 0.5 to 5 wt %.

If the crosslinking accelerator is added to the oil, the amount of oil gum-up transferred onto rolls, etc. can be successfully decreased while the strength of carbon fibers can be successfully improved. This can overcome the conventional contradictory relation between the effect of improving strength by using a heat resistant oil and the increase of gum-up on high temperature drums. It is estimated that the crosslinking accelerator added causes the oil to be crosslinked earlier, allowing the transferable viscosity range to be passed by in a shorter period of time, and as a result, the oil film becomes so stronger as not to be transferred onto the high temperature drums. The crosslinking accelerator added is effective to improve the residue rate (r) after heat treatment.

It is preferable that the amount of the crosslinking accelerator added is 0.01 to 200 wt % based on the weight of the silicone compounds, and a more preferable range is 0.5 to 150 wt %.

The crosslinking accelerator can be mixed with the oil beforehand, or after oiling, it can be applied separately to precursor fibers by such a means as spraying or dropwise addition. Especially if the crosslinking accelerator is applied after oiling, it is preferable for uniform application to pass the precursor fibers through said zigzag passage of free rollers.

When the crosslinking accelerator is mixed with the oil, it is preferable to keep the temperature at 15° C. or lower, more preferable to keep at 5° C. or lower, or to mix immediately before application to the fibers, since otherwise the stability of the oil may decline.

To prevent the coalescence between single filaments, it is also effective to use fine particles together. It is preferable that the diameters of the fine particles are 0.01 to 3 $\mu$m. A more preferable range is 0.03 to 1 $\mu$m, and a further more preferable range is 0.05 to 0.5 $\mu$m. The fine particles can be either inorganic or organic, but organic fine particles are preferable since they are not too hard and do not flaw the fibers. Among the organic compounds which can be used as the fine particles, crosslinked polymethyl methacrylate, crosslinked polystyrene, etc. are especially preferable. Especially the modification of the fine particles by amino groups, etc. allows the affinity with the precursor fibers to be improved. The fine particles are mixed with the oil as a water emulsion, or applied separately to the precursor fibers by spraying or dropwise addition. A preferable emulsifier is a nonionic surfactant.

The surfactant used for emulsifying silicone compounds or fine particles can be any of various surfactants, but as described before, a nonionic surfactant is preferable in view of solution stability and influence on the physical properties of carbon fibers. In this case, it is preferable that the amount of the emulsifier is 50 wt % or less based on the weight of the silicone compounds. More preferable is 30 wt % or less, and further more preferable is 10 wt % or less. Since the heat resistance of the emulsifier is lower than that of silicone compounds, a smaller amount of the emulsifier is more effective for improving the heat resistance of the oil as a whole.

After oiling, the fibers are dried and densified. The heat treatment for drying and densifying once lowers the viscosity of the oil, allowing it to be uniformly dispersed into the bundles, and further heat treatment promotes the crosslinking of the oil, to improve the heat resistance of the oil. Therefore, also considering the productivity, it is preferable to heat-treat at a temperature as high as possible, but for preventing the coalescence between single filaments, it is preferable that the heat treatment temperature is set in a temperature range from the melting point of the polymer in wet heat to a temperature lower than it by 20° C. If the heat treatment temperature almost after completion of drying when the water content of the sized oil becomes 1% or less is set in a temperature range between the melting point of the polymer in wet heat to a temperature higher than it by 60° C., the drying and densifying time can be shortened and it is also effective for promoting the crosslinking of the oil to strengthen the oil film.

After completion of drying and densifying, further drawing in a high temperature heat carrier such as pressure steam, as required, is effective for improving the orientation of the precursor fibers, and in this case, the use of pressure steam is especially preferable. Also in this case, it is preferable to draw in a temperature range from the melting point of the polymer in wet heat to a temperature lower than it by 20° C. It is preferable that the drawing ratio is 2 to 10 times, and a range from 3 to 8 times is more preferable. It is preferable that the drawing tension in a high temperature heat carrier such as pressure steam is 10 to 40 N per 3,000 filaments, and a more preferable range for promoting the substantial orientation is 12 to 25 N. So, it is preferable to optimize the temperature, etc. to keep the drawing tension in this range.

As the total drawing ratio in the spinning and drawing process including the drawing in hot water baths, 7 times or more are preferable, and 10 times or more are more preferable to improve the orientation of fibers and also to improve the productivity of spinning and drawing. The proper upper limit of the total drawing ratio in the spinning and drawing process is 20 times or less in view of grade such as fuzz. As the high temperature heat carrier, glycerol, etc. can be used.

After completion of pressure steam drawing or high temperature heat carrier drawing, as required, a finishing oil is applied to the precursor fibers.

In view of productivity, it is preferable that the fineness of the single filaments of precursor fibers is 0.5 denier or more, and more preferable is 1 denier or more. If the fineness of single filaments is too large when the number of filaments remains the same, the calorific value in the heat treatment process, particularly in the stabilization process is too large, and the stabilization temperature cannot be raised to lower the productivity. So, it is preferable that the upper limit of fineness is 2 deniers or less, and more preferable is 1.7 deniers or less.

The number of single filaments constituting the precursor fibers is not limited. In view of productivity, a preferable number is 1,000 filaments or more, and more preferable is 10,000 or more. Further more preferable is 20,000 or more. The present invention can also be effectively applied to a thick strand of 500,000 filaments or more. As for the spinneret, it is preferable that the number of spinning holes per spinneret is 3,000 or more, and more preferable is 6,000 or more. The proper upper limit in the number of holes is 100,000 or less, since a very large spinneret lowers the handling convenience.

A higher spinning and drawing speed means a higher productivity. So, a speed of 300 m/min or more is preferable, and 400 m/min or more is more preferable. Further more preferable is 450 m/min or more. The proper upper limit of spinning and drawing speed is considered to be 800 m/min or less in view of spinning speed, upper limit of drawing ratio, spinning and drawing processability, etc.

Furthermore, the precursor fibers of the present invention are characterized in that the outer layer of each single filament has portions of the largest stabilization inhibitor content and the largest silicon content.

The outer layer of each single filament for the distributions of stabilization inhibitor and silicon refers to a region from the surface of the filament to ⅓ or less of the distance from the surface to the cross sectional center of the filament. A region of ⅕ or less is preferable. That is, a state that the stabilization inhibitor and silicon are most concentrated in a region close to the surface of each single filament is preferable.

The stabilization inhibitor of the present invention refers to an element which acts to retard the fiber oxidation reaction in the stabilization process, i.e., the stabilization reaction.

Usually in each single filament of carbon fibers, the modulus of the outer layer is higher than that of the inner layer. Under tensile stress, the stress is concentrated at the surface of each filament, and if the surface has a defect, the defect becomes a fracture start point, to cause fracture. The modulus distribution is caused by the difference in the progression of stabilization between the inner and outer layers. The difference in the progression of stabilization is considered to be caused since the oxygen permeation into the inner layer is retarded or does not occur, to retard the stabilization of the inner layer. In this regard, retarding the stabilization of the outer layer is effective for decreasing the difference in the progression of stabilization between the inner and outer layers, hence for uniformizing the modulus distribution caused by said difference in each single filament of carbon fibers. However, if the stabilization of the outer layer is retarded, the heat resistance of the outer layer declines, and as a result, the coalescence between single filaments is liable to occur in the stabilization process.

Therefore, it is an effective method for obtaining carbon fibers with a high strength that silicone compounds are used for letting the single filaments contain silicon, thereby inhibiting the coalescence between single filaments. In addition, as described later, if a stabilization inhibitor like boric acid is added, the crosslinking of the silicone compounds is also promoted, to provide a remarkable effect of improving the strength more than expected to be provided by a simple combination.

Since the stabilization of the outer layer can be retarded, the difference in Young's modulus between the inner and outer layers decreases compared to that in the conventional carbon fibers, and the coalescence between single filaments is inhibited to lessen the macro-defects of the obtained carbon fibers. As a result, carbon fibers with a high tensile strength and elongation and a high critical stress intensity factor can be obtained.

In this case, it is preferable to introduce the stabilization inhibitor like a ring in the outer layer of each single filament of polyacrylonitrile based fibers, or in such a manner that the element content decreases toward the inner layer, since the stabilization of the outer layer can be retarded to homogenize the stabilized structure in the inner and outer layers.

It is preferable that the stabilization inhibitor is one or more elements selected from B, Ca, Zr, Mg, Ti, Y, Cr, Fe, Al, Sr and lanthanoide elements. One or more elements selected from B, Ca, Zr, Ti and Al are more preferable. One or more elements selected from B, Ca and Zr are further more preferable. In this case, each element can be an element itself or a compound containing it.

In view of large stabilization retarding effect, safety, price, handling convenience, etc., a boron compound is most preferable. The boron compounds which can be used here include boric acid, metaboric acid, tetraboric acid and their metal salts and ammonium salts, diboron trioxide and borates. As described before, water soluble boron compounds such as boric acid, metaboric acid, tetraboric acid, and their metal salts and ammonium salts are preferable. If a metal is contained, it can happen that defects are formed during carbonization to lower the strength on the contrary. So, boron compounds not containing any metal such as boric acid, metaboric acid, tetraboric acid and their ammonium salts are more preferable.

As silicon, a silicone compound is preferable. A preferable method for introducing silicon into single filaments is to apply a silicone compound as an oil to precursor fibers. It is preferable that the composition, properties, etc. are the same as those of said silicone compounds with high heat resistance. Furthermore, it is more preferable to contain said crosslinking accelerator.

The stabilization inhibitor content is measured by ICP emission spectral analysis. It is preferable that the amount (DV) of the stabilization inhibitor introduced is 0.001 to 10 wt % based on the weight of the entire fibers, and a more preferable range is 0.01 to 5 wt %. If the content is less than 0.001 wt %, the effect of introducing the stabilization inhibitor cannot be manifested. If more than 10 wt %, the structure of single filaments may become greatly coarse by the stabilization inhibitor, to lower the performance of carbon fibers.

The silicon content is also measured by ICP emission spectral analysis similarly. It is preferable that the amount of silicon introduced is 0.01 to 3 wt % based on the weight of the entire fibers, and a more preferable range is 0.1 to 2 wt %. If the content is less than 0.01 wt %, the effect of preventing the coalescence between single filaments cannot be manifested, and if more than 3 wt %, more exhaust gas and fine particles may be scattered in the carbonization process, to adversely affect the performance and process.

It is preferable that the stabilization inhibitor is distributed to be contained more in the outer layer of each single filament and to be contained less in the inner layer, since the inner layer of the single filament can be homogeneously stabilized. So, it is preferable that the ratio (R) of the stabilization inhibitor content in the outer layer of each single filament to that in the inner layer defined by the following formula (h-1) is 5 to 1,000. A more preferable range is 10 to 1,000, and a further more preferable range is 20 to 1,000.

If the content ratio (R) exceeds 1,000, the stabilization inhibitor content in the outer layer is too high or that in the inner layer is too low, and the effect of improving the strength by homogeneous stabilization may not be able to be observed.

$$R=C_0/Ci \quad \text{(h-1)}$$

where $C_0$ is the element count in the outer layer of each single filament measured by SIMS, and Ci is the element count in the inner layer of each single filament measured by SIMS. The outer layer of each single filament refers to a portion at a depth of 1% of the diameter of the single filament from the surface, and the inner. layer of each single filament refers to a portion at a depth of 15% of the diameter of the single filament from the surface.

That is, it is preferable that the stabilization inhibitor exists as a ring in the surface layer of each single filament, or exists to decline in content toward the inner layer. In other words, it is preferable to have a two-layer structure consisting of a layer with the stabilization inhibitor existing along the surface and a layer free from the stabilization inhibitor, or a gradient structure with the stabilization inhibitor content declining toward the inner layer.

It is preferable that the local highest stabilization inhibitor content in the outer layer of each single filament is 0.01 to 10 wt %, and a more preferable range is 0.5 to 3 wt %.

It can happen that the silicon due to the silicone oil penetrating inside the single filament remains still after carbonization, to form defects, hence lowering the strength of carbon fibers. So, it is preferable that the stabilization inhibitor is localized in the surface of each single filament of precursor fibers and kept away from the inside of the single filament as far as possible. From this point of view, it is preferable that the ratio (R) of the silicon content in the outer layer of each single filament to that in the inner layer defined by the formula (h-1) is 10 to 10,000. A more preferable range is 100 to 10,000, and a further more preferable range is 400 to 10,000. It is preferable that the content ratio (R) is larger, but according to the finding by the inventors, it is difficult to keep the content ratio (R) at 10,000 or more.

The conditions for measuring the ratio of the stabilization inhibitor content or silicon content in the outer layer of each single filament to that in the inner layer by a secondary ion mass spectrometer (SIMS) are as follows. Precursor fibers are arranged, and irradiated with primary ions in vacuum from a side of the fibers, to measure the secondary ions generated. Instrument: A-DIDA3000 produced by Atomika, Germany, Primary ion species: $O^{2+}$, Primary ion energy: 12 keV, Primary ion current: 100 nA, Raster range: 250×250 μm, Gate rate: 30%, Analyzed range: 75×75 μm, Detected secondary ions: Positive ions, Electron spray conditions: 0.6 kV–3.0 A (F7.5), Vacuum degree during measurement: $1\times10^{-8}$ Torr, and H-Q-H:#14.

The process for producing the precursor fibers of the present invention is described below.

In the case of precursor fibers with a stabilization inhibitor contained in the outer layer of each single filament, even if the polymer does not contain said oxygen permeation promoter, the stabilization in the inner layer can be accelerated compared to the fibers not containing any stabilization inhibitor. So, a copolymer consisting of 95 mol % or more, preferably 98 mol % or more of acrylonitrile (AN), and 5 mol % or less, preferably 2 mol % or less of a vinyl-group-containing compound capable of accelerating stabilization and of being copolymerized with acrylonitrile (AN) (hereinafter called a vinyl based monomer) can be used.

It is preferable that the vinyl based monomer capable of accelerating stabilization is acrylic acid, methacrylic acid or itaconic acid, and as described before, an ammonium salt obtained by neutralizing it partially or wholly by ammonia is preferable.

However, containing a densifying accelerator is effective for improving the strength of carbon fibers as described before, and further copolymerizing an oxygen permeation promoter is effective for further decreasing the structural difference between the inner and outer layers of each single filament in the stabilization process, for improving the strength and modulus of carbon fibers. Therefore, even when a stabilization inhibitor is contained, a polymer obtained by copolymerizing said four accelerators including two promoters is more preferable.

For polymerization, as described before, conventionally known solution polymerization, suspension polymerization, emulsion polymerization, etc. can be applied.

The spinning dope composed of said acrylonitrile based polymer is spun by wet spinning, dry jet spinning, dry spinning or melt spinning, to obtain fibers. Dry jet spinning is especially preferable.

The coagulated fibers obtained are washed with water, drawn, dried, sized with an oil, etc. in the spinning and drawing process, to produce precursor fibers. During or after completion of the spinning and drawing process, a stabilization inhibitor is added to the precursor fibers.

It is preferable that the stabilization inhibitor is one or more elements selected from B, Ca, Zr, Mg, Ti, Y, Cr, Fe, Al, Sr and lanthanoide elements, but a boron compound aqueous solution is most preferable. Especially an aqueous solution of boric acid, metaboric acid or tetraboric acid is more preferable. The boron compound also has an effect of inhibiting the flawing of single filaments and preventing the coalescence between single filaments, since it reacts with a silicone, to promote the strong crosslinking of the silicone oil, for forming a strong oil film.

The stabilization inhibitor can be added at any point of the spinning and drawing process. It is preferable to add the stabilization inhibitor when the precursor fibers remain swollen before being dried and densified. It is also preferable to mix the stabilization inhibitor with the silicone oil, for applying to the precursor fibers together with the silicone oil, since the process can be simplified and since it is also effective for promoting the crosslinking of the silicone oil as described above.

The densenesses of the outer and inner layers of each single filament of bath-drawn fibers to have the stabilization inhibitor applied affect the stabilization inhibitor content distribution in the single filament directly, to also affect the physical properties of carbon fibers. A compound containing a stabilization inhibitor, such as a boron compound is generally smaller in molecule than a silicone oil, and therefore is liable to penetrate inside the single filament. When a stabilization inhibitor is applied together with a silicone oil, it is preferable to raise the denseness of the outer layer of each single filament for inhibiting the penetration of the silicone oil into the inside and to densify the inner layer, for preventing that the content near the center becomes high.

To raise the denseness of the outer layer of each single filament, it is preferable to draw at a higher temperature as described before. It is preferable that the highest temperature of the drawing baths is 50° C. or higher. More preferable is 70° C. or higher, and further more preferable is 90° C. or higher. To raise the denseness of the inside of each single filament, as described before, it is effective to copolymerize a densifying accelerator, or to raise the polymer concentration of the polymer dope or to coagulate at a lower temperature.

It is preferable that the silicone oil is composed of modified silicones and has high heat resistance. It is preferable that the amount of the silicone oil applied is 0.2 to 2.0 wt % based on the weight of dry fibers.

The precursor fibers drawn in baths are dried on a hot drum, etc., to be dried and densified. Since the drying temperature and time affect the distribution of boron in each single filament, it is preferable to optimize the conditions. As required, the dried and densified precursor fibers are drawn in a high temperature heat carrier such as pressure steam, to have a predetermined fineness and a predetermined orientation degree.

It is preferable that the fineness, orientation degree, etc. of precursor fibers are in ranges explained above.

The precursor fibers obtained like this are further stabilized and carbonized to obtain carbon fibers with a high strength and elongation.

<Stabilization of precursor fibers>

The conditions for stabilizing precursor fibers are a factor as important as the polymer composition and the properties of the precursor fibers in deciding the two-layer structure of the inner and outer layers of each single filament. Especially the stabilization temperature greatly affects the two-layer structure.

It is preferable that the stabilization temperature is 200 to 300° C. Especially it is preferable in view of cost and performance that stabilization is effected at a temperature of 10 to 20° C. lower than the temperature at which fiber breakage is caused by the reaction heat accumulated according to the progression of stabilization.

It is preferable that the tension in the stabilization process is higher, since the strength of the carbon fibers obtained is improved. However, if the tension is high, fuzz is liable to occur, to lower the processability of stabilization. Specifically a tension of 2 to 30 N/12 kD is preferable, and a tension of 5 to 25 N/12 kD is more preferable. A tension of 10 to 20 N/12 kD is further more preferable.

It is preferable that the drawing ratio in this case is 0.8 to 1.3, but in view of processability, etc., a range of 0.85 to 1.0 is more preferable, and a range of 0.85 to 0.95 is further more preferable. If the drawing ratio is kept in this range, carbon fibers with little edge fuzz and with few macrodefects can be obtained.

With regard to the progression of stabilization, it is preferable to stabilize till the specific gravity of the stabilized fibers obtained becomes 1.2 to 1.5. A range of 1.25 to 1.45 is more preferable, and a range of 1.3 to 1.4 is especially preferable in view of strength and carbonization processability.

Stabilization is effected in an oxidizing atmosphere such as air, but stabilization in an inert atmosphere such as nitrogen partially in the beginning or later in the process is also effective in view of higher productivity. Since the stabilization consists of thermal cyclization and unsaturation by oxygen, the cyclization can be effected at a higher temperature for assuring a higher productivity in an inert atmosphere free from the runaway reaction otherwise possibly caused due to the presence of oxygen.

It is preferable that the stabilization time is 10 to 100 minutes in view of productivity and performance of carbon fibers, and a range of 30 to 60 minutes is more preferable. The stabilization time in this case refers to the total time during which the precursor fibers remain in the stabilization furnace. If this time is too short, the two-layer structure may become so clear as to lower the performance disadvantageously.

It is a preferable condition for the carbon fibers of the present invention that when a cross section of each stabilized fiber obtained by stabilization and embedded in a resin is polished and observed with an optical microscope at 400 times, the two-layer structure consisting of inner and outer layers is not observed. If a structural difference is formed between the inner and outer layers due to the difference in the progression of stabilization, a two-layer structure consisting of the inner and outer layers is clearly observed on the plished cross section. It is preferable for letting carbon fibers manifest a high strength that the copolymerization of said oxygen permeation promoter or the addition of said stabilization inhibitor causes the two-layer structure due to stabilization to vanish, for forming a uniformly colored homogeneous structure. Therefore, it is preferable to decide the stabilization conditions to let the cross sectional two-layer structure of each single filament of stabilized fibers vanish, in relation with the copolymerized amount of the oxygen permeation promoter, the added amount of the stabilization inhibitor and the denseness of the precursor fibers.

The stabilized fibers obtained like this are then carbonized, and furthermore, as required, graphitized, to obtain carbon fibers.

As a carbonization or graphitization condition to obtain the carbon fibers of the present invention, the highest temperature of the inert atmosphere should be 1,100° C. or higher. Preferable is 1,200° C. or higher. The highest temperature of lower than 1,100° C. is unpreferable since the carbon fibers obtained have a high moisture content. It is preferable that the upper limit of the carbonization temperature is 2,000° C. or lower, and more preferable is 1,800° C. or lower. If the temperature is higher than 2,000° C., nitrogen tends to be released, causing micro-voids to be liable to be formed in the single filaments to lower the strength. However, it is also allowed to carbonize in an inert atmosphere of 2,000° C. to 3,300° C. for obtaining graphitized fibers, and in this case, the graphitized fibers have a strength higher than that of the conventional graphitized fibers.

To obtain carbon fibers with a high strength, it is preferable that the carbonization temperature is 1,200 to 1,600° C., and a range of 1,300 to 1,500° C. is more preferable.

In the carbonization process, it is effective for preventing the self contamination by the generated gas to decrease macro-defects, that the gas is allowed to be emitted from near the strand at a high temperature region in a temperature range in which the weight is decreased due to the generated gas. It is especially important to emit the gas in a temperature range of 400 to 500° C., and furthermore it is effective to emit in a temperature range of 1,000 to 1,200° C.

It is preferable to pay attention to the temperature rising rate and tension during carbonization, in view of strength and modulus. It is preferable to keep the temperature rising rate at 1,000° C./min or less in the respective temperature ranges of 300 to 500° C. and 1,000 to 1,200° C., and more preferable is 500° C./min or less. Furthermore, it is preferable in view of higher strength, to keep the tension higher to such an extent that fuzz does not come into problem. Specifically it is preferable that the tension in a range of 1,000° C. or lower is 0.05 to 15 N/12 kD. A tension of 1 to 10 N/12 kD is more preferable, and a tension of 2 to 6 N/12 kD is further more preferable. Moreover, in the highest temperature range of 1,000° C. or higher, a tension of 2 to 50 N/12 kD is preferable, and a tension of 8 to 30 N/12 kD is more preferable. A tension of 10 to 20 N/12 kD is further more preferable.

In this case, it is preferable that the drawing ratio is 0.8 to 1.1 times. A range of 0.85 to 1.0 time is more preferable, and a range of 0.85 to 0.95 is especially preferable.

The obtained carbon fibers are further treated on the surfaces, to be improved in adhesiveness to the matrix of the composite material.

The surface treatment can be vapor phase treatment or liquid phase treatment. In view of productivity, variance, etc., electrolytic treatment is preferable.

The electrolytes which can be used for the electrolytic treatment include acids such as sulfuric acid, nitric acid and hydrochloric acid, alkalis such as sodium hydroxide, potassium hydroxide and tetraethylammonium hydroxide, and their salts. An aqueous solution containing ammonium ions, for example, ammonium nitrate, ammonium sulfate, ammonium persulfate, ammonium chloride, ammonium bromide, ammonium dihydrogenphosphate, diammonium hydrogenphosphate, ammonium hydrogencarbontate, ammonium carbonate, etc. or any of their mixtures can be used.

The quantity of electricity for electrolytic treatment depends on the carbon fibers used. More highly carbonized carbon fibers require a larger quantity of electricity. As the surface treatment quantity, it is preferable that the surface oxygen content of carbon fibers, O/C, and surface nitrogen content of carbon fibers, N/C, respectively measured by X-ray photoelectron spectroscopy (ESCA) are 0.05 to 0.40 and 0.02 to 0.30 respectively.

If these conditions are applied, the adhesion between the carbon fibers and the matrix can be kept at an optimum level. So, such problems that the adhesion is so strong as to cause very brittle fracture, resulting in the decline of strength or that though the strength is high, the adhesive strength is too low to manifest mechanical properties in the non-fiber direction can be prevented, and a composite with properties balanced in both lengthwise and crosswise directions can be obtained.

The obtained carbon fibers are as required further sized. It is preferable that the sizing agent used is compatible with the matrix, and the sizing agent is selected to suit the matrix.

The present invention is achieved by combining a technique to use a polymer composition containing said four accelerators including two promoters for manifesting a high strength with a large single filament diameter and a technique to apply a specific oil, for example, a mixed oil consisting of specific silicone compounds, fine particles and ammonia compound to precursor fibers for preventing the coalescence between single filaments likely to be caused by said much copolymerized polymers. The present invention succeeds in producing carbon fibers with a high strength using a set of unprecedentedly thick single filaments.

The resin used as the matrix for producing the prepreg or composite material is not especially limited, and can be selected from conventionally used epoxy resins, phenol resins, polyester resins, vinyl ester resins, bismaleimide resins, polyimide resins, polycarbonate resins, polyamide resins, polypropylene resin, ABS resin, etc. As the matrix, cement, metal or ceramic, etc. can also be used, as well as a resin.

Examples for producing a prepreg or composite material using the carbon fibers of the present invention are described below. A sheet impregnated with a resin, in which the carbon fibers obtained according to the above method are paralleled in one direction, may be produced as a unidirectional prepreg, or a woven fabric prepreg may also be produced by impregnating a woven fabric of carbon fibers with a resin. A composite material can be obtained by laminating and curing the prepreg in layers, or as another method, the filament winding method for directly winding filaments while impregnating them with a resin without producing any prepreg can also be applied. Furthermore, a method in which chopped fibers are kneaded with a resin for extrusion and a method in which long fibers are drawn together with a resin can also be used. These methods can be used to produce prepregs and composite materials.

The carbon fibers of the present invention can also be used for such molding methods as hand lay-up molding, press molding, autoclave molding and pultrusion molding after processing them once into a sheet molding compound (SMC) or chopped fibers, etc., as well as for prepregs.

The carbon fibers of the present invention, and the prepreg and composite material produced by using them can be used as primary structural materials of air craft, sporting goods such as golf shafts, fishing rods, snow boards and ski sticks, marine goods such as masts of yachts and hulls of boats, energy and general industrial apparatuses such as fly wheels, CNG tanks, wind mills and turbine blades, materials for repairing and reinforcing roads, bridge piers, etc., architectural members such as curtain walls, and so on. Furthermore, light-weight members and structures which cannot be produced by conventional techniques can also be produced. For example, very light-weight golf shafts of 40 g or less can also be produced.

In these applications, it is not sufficient that mechanical properties are excellent, and cost is another important factor for material selection. The carbon fibers of the present invention satisfy this demand.

EXAMPLES

The present invention is described below more concretely in reference to examples.

The properties of a composite material in the present invention were evaluated according to the following methods. The resin was prepared as described below according to Example 1 disclosed in Japanese Patent Publication (Kokoku) No. 4-80054. Three point five (3.5) kilograms (35 parts by weight) of Epikote 1001 produced by Yuka Shell Epoxy, 2.5 kg (25 parts by weight) of Epikote 828 produced by Yuka Shell Epoxy, 3.0 kg (30 parts by weight) of Epichlon N740 produced by Dainippon Ink & Chemicals, Inc., 1.5 kg (15 parts by weight) of Epikote 152 produced by Yuka Shell Epoxy, 0.3 kg (3 parts by weight) of Denkaformal #20 produced by Denki Kagaku Kogyo and 0.5 kg (5 parts by weight) of dichlorophenyldimethylurea were stirred for 30 minutes to obtain a resin composition. Release paper was coated with the resin composition, for use as a resin film.

At first, around a steel drum of about 2.7 m in circumference, a resin film obtained by coating silicone-coated paper with a resin to be combined with carbon fibers was wound, and on the resin film, carbon fibers unwound from a creel were wound to be arranged through a traverse mechanism. The fibers were further covered with said resin film. The laminate was rotated and pressurized by a pressure roll, to make the fibers impregnated with the resin, for making a unidirectional prepreg with a width of 300 mm and a length of 2.7 m.

In this case, for better resin impregnation into the clearances between fibers, the drum was heated at 60~70° C., and the drum speed and the traverse feed rate were adjusted to prepare a prepreg with an areal unit weight of about 200 g/m$^2$ and a resin quantity of about 35 wt %. The prepreg was cut to prepare a unidirectional laminate with a thickness of about 1 mm.

From the obtained unidirectional laminate, a specimen with a width of 12.7 mm and a length of 230 mm was prepared. Tabs made of GFRP with a thickness of about 1.2 mm and a length of 50 mm were bonded at both the ends of the specimen (as required, a strain gauge was stuck at the center of the specimen to measure the modulus and breaking strain), for measuring at a strain rate of 1 mm/min.

Furthermore, the surface oxygen content O/C and the surface nitrogen content N/C were measured using ESCA according to the following procedure. At first, a carbon fiber bundle, from which the sizing agent, etc. were removed by a solvent such as dimethylformamide, was cut and spread on a sample holder made of stainless steel. The photo-electron escape angle was set at 90°, and MgK $\alpha_{1,2}$ was used as the X-ray source. The sample chamber was internally kept at a vacuum degree of $1\times10^{-8}$ Torr. For correcting the peak affected by the electrification at the time of measurement, at first, the binding energy B.E. of the main peak of $C_{1S}$ was set at 284.6 eV. The $C_{1S}$ peak area was obtained by drawing a straight base line in a range of 282 to 296 eV. The $O_{1s}$ peak area was obtained by drawing a straight base line in a range of 528 to 540 eV, and the $N_{1S}$ peak area was obtained by drawing a straight base line in a range of 398 to 410 eV. As the surface oxygen content O/C, used was the ratio of numbers of atoms calculated by dividing the ratio of the $O_{1S}$ peak area to the $C_{1S}$ peak area by the sensitivity correction value peculiar to the instrument. If ESCA-750 produced by Shimadzu Corp. is used, the sensitivity correction value peculiar to the instrument is 2.85. Similarly, as the surface nitrogen content N/C, used was the ratio of numbers of atoms calculated by dividing the ratio of the $N_{1S}$ peak area to the $C_{1S}$ peak area by the sensitivity correction value peculiar to the instrument. If ESCA-750 produced by Shimadzu Corp. is used, the sensitivity correction value peculiar to the instrument is 1.7.

Moreover, the element content in the fibers was measured according to the following method. A sample was taken in a sealed container made of teflon, and heated and decomposed using sulfuric acid and then nitric acid, and adjusted to a constant volume. Then, Sequential Model ICP SPS1200-VR produced by Seiko Electric corp. was used as an ICP emission spectrometer for measurement.

The ratio of the orientation degree in the outer layer of each single filament to that in the inner layer by selected-area electron diffraction was obtained as described below.

Carbon fibers were paralleled in fiber axis direction and embedded in a room temperature curing epoxy resin, and the resin was cured. The cured carbon fiber embedded block was trimmed to expose at least two or three single filaments of the embedded carbon fibers, and a very thin longitudinal carbon fiber cross section through the center of fiber with a thickness of 15 to 20 nm was prepared using a microtome equipped with a diamond knife. The very thin cross section was placed on a micro-grid with gold vapor-deposited, and a high resolution electron microscope was used for electron diffraction. To detect the structural difference between the inner and outer layers of each single filament of carbon fibers, electron diffraction images from specific portions were examined by using the selected-area electron diffraction. As measuring conditions, at an accelerating voltage of 200 kV, and at a selected-area with a diameter of 0.2 $\mu$m, electron diffraction images were photographed at respectively five points in a depth range of within 0.3 $\mu$m in depth from the surface of a single filament and in a depth range from the center of a single filament to within 0.4 $\mu$m. The center of a single filament in this case refers to the center of the inscribed circle with the largest radius in a cross section of a single filament.

In succession, for (002) of the electron diffraction images, the respective scanning profiles of diffraction intensities in the meridian direction were prepared. For the respective scanning profiles, half value widths (degrees) were obtained. The half value widths of five points were averaged as H, and the orientation degree $\pi002$ (%) was obtained from the following formula: $\pi002=100\times(180-H)/180$. The ratio R of the orientation degree of the outer layer of each single filament to that of the inner layer was defined by the following formula:

$$R=\pi_0/\pi i$$

where $\pi_0$ is the orientation degree of the outer layer and $\pi i$ is the orientation degree of the inner layer.

On the other hand, as the electron microscope, Model H-800 (transmission type) produced by Hitachi, Ltd. was used.

In the carbon fibers of the present invention, since the modulus distribution in the inner and outer layers of each single filament is small, the ratio (R) of the orientation degree of the outer layer to that of the inner layer is 1.3 or less. If the orientation degree distribution is smaller, the stress concentration at the surface with many defects decreases. So, it is preferable that the ratio (R) of the orientation degree of the outer layer to that of the inner layer is 1.2 or less. More preferable is 1.1 or less, and further more preferable is 1.05 or less.

Example 1

A copolymer consisting of 96.3 mol % of acrylonitrile (AN), 0.7 mol % of methacrylic acid, 1 mol % of isobutyl methacrylate and 2 mol % of methyl acrylate was produced by solution polymerization, to obtain a spinning dope with a concentration of 22%. After completion of polymerization, ammonia gas was blown in till the pH reached 8.5, to neutralize methacrylic acid, for introducing ammonium groups into the polymer, thereby improving the hydrophilicity of the spinning dope. The obtained spinning dope was controlled at 40° C. and spun using a spinneret with 6000 holes respectively with a diameter of 0.15 mm, once into air, to pass a space of about 4 mm, then being introduced into a coagulating bath of 35% DMSO (dimethylsulfoxide) aqueous solution controlled at 3° C. for coagulation, according to the dry jet spinning method. The swelling degree of the coagulated fibers was 220%. The coagulated fibers were washed with water and drawn in hot water. Four baths were used for drawing, and the temperature was raised in steps of 10° C. from the first bath, with the temperature of the fourth bath set at 90° C. The drawing ratio in the baths was 3.5 times. To prevent the coalescence between single filaments, the fibers were introduced into the respective baths with the inlet roller raised from each bath, and a vibration guide was installed in each of the baths. The vibration frequency was 25 Hz and the amplitude was 2 mm. The swelling degree of the bath-drawn fibers was 73%.

Fine particles (0.1 μm in average particle size) of polymethyl methacrylate crosslinked by divinylbenzene were emulsified in a silicone oil consisting of an amino-modified silicone, epoxy-modified silicone and ethylene-modified silicone, to prepare an emulsion, and the drawn fibers obtained above were fed through an oil bath formed by a mixture consisting of said emulsion and ammonium carbonate, to have the oil and fine particles sized on them. The viscosities of the amino-modified silicone, epoxy-modified silicone and ethylene-modified silicone at 25° C. were 15000 cSt, 3500 cSt and 500 cSt respectively. The residue rates of the oil formed by a mixture of these components after heat treatment in air and nitrogen were 82% and 71% respectively. The mixing rates of the oil, fine particles and ammonium carbonate were 85%, 13% and 2% respectively.

Furthermore, heating rollers of 150° C. were used for drying and densifying. The crosslinking rate of the oil by drying and densifying was 0.02 g/hour·12000 filaments.

The dried and densified fibers were further drawn in pressure steam of 3 kg/cm$^2$G, to achieve a spinning and drawing ratio of 13 times, and acrylic fibers of 12,000 filaments with a single filament fineness of 1 d were obtained. The final spinning and drawing speed was 400 m/min.

The strength, elongation and crystallite orientation of the obtained precursor fibers were 7.1 g/d, 10.5% and 91.5% respectively. The ΔL value by of the precursor fibers by iodine adsorption was 25. The cross section of the precursor fibers was observed by TEM at one million times, and no micro voids were observed in the surface layer of each filament.

The precursor fibers were stabilized in an air oven of atmospheric pressure at 250° C. for 15 minutes, and further stabilized at 270° C. for 15 minutes, to obtain stabilized fibers. The oxygen content distribution in the depth direction of the stabilized fibers was obtained by secondary ion mass spectrometry (SIMS). The oxygen content in the inner layer of each single filament was $1/3.5$ of the oxygen content in the surface.

The obtained fiber bundles were heated in 230~260° C. air at a drawing ratio of 0.90, to be converted to stabilized fibers with a moisture content of 8%. The stabilized fibers were carbonized in nitrogen atmosphere at a temperature rising rate of 400° C./min in a temperature range of 300 to 500° C. and at a temperature rising rate of 500° C./min in a temperature range of 1000 to 1200° C. up to 1400° C. at a drawing ratio of 0.92. After completion of carbonization, the fibers were subjected to anode oxidation treatment at 10 coulombs/g-CF in ammonium carbonate aqueous solution. The final carbonization speed was 10 m/min.

The carbon fibers thus obtained had a single filament diameter of 7.0 μm, carbon fiber strength of 6.5 GPa, modulus of 260 GPa and elongation of 2.52%. The tensile strength of carbon fiber bundles was 560 N. The obtained carbon fibers were used to form a composite material, and its 0° tensile strength was measured and found to be 3.5 GPa. The obtained carbon fibers had a silicon content Si/C of 0.08.

The cross section of the obtained carbon fibers was observed by TEM, but no ring pattern was observed in the range from the surface layer to the inside. Fracture surfaces of single filaments were observed, and as a result, macro-defects accounted for 45% while micro-defects accounted for 55%. As for the chemical function contents of the obtained carbon fibers, O/C was 0.15 and N/C was 0.06.

The critical stress intensity factor $K_{IC}$ was 3.6 MPa·m$^{1/2}$, and the ratio R of the silicon content in the outer layer of each single filament to that in the inner layer was 550. The difference (RD) between inner and outer layers obtained by RAMAN was 0.04, and the difference (AY) between inner and outer layers obtained by AFM was 71.

Example 2

Carbon fibers were obtained as described in Example 1, except that a copolymer consisting of 97.0 mol % of acrylonitrile (AN), 0.6 mol % of acrylic acid, 1 mol % of normal butyl methacrylate and 1.4 mol % of ethyl acrylate was produced by solution polymerization, that a spinning dope with a concentration of 18% was used and that the single filaments of precursor fibers had a fineness of 0.5 denier.

The carbon fibers thus obtained had a single filament diameter of 4.9 μm, carbon fiber strength of 7.5 GPa, modulus of 290 GPa and elongation of 2.58%. The tensile strength of carbon fiber bundles was 710 N. The obtained carbon fibers were used to form a composite material, and its 0° tensile strength was measured and found to be 3.95 GPa.

The critical stress intensity factor $K_{IC}$ was 3.7 MPa·m$^{1/2}$ and the ratio (R) of the silicon content in the outer layer to the inner layer was 480.

Example 3

Carbon fibers were obtained as described in Example 1, except that a copolymer consisting of 96.0 mol % of acrylonitrile (AN), 1.0 mol % of acrylic acid, 1 mol % of normal butyl methacrylate and 2.0 mol % of ethyl acrylate was produced by solution polymerization, that a spinning dope with a concentration of 18% was used and that a junction type spinneret for fibers with a special cross sectional form was used.

The obtained carbon fibers had an average single filament diameter of 7.0 μm, carbon fiber strength of 6.8 GPa, modulus of 270 GPa and elongation of 2.52%. The tensile strength of carbon fiber bundles was 540 N. The obtained carbon fibers were used to form a composition material, and its 0° tensile strength was measured and found to be 3.55 GPa.

The obtained carbon fibers had a silicon content Si/C of 0.08. The cross section of the carbon fibers was observed by TEM, and no ring pattern was observed in the range from the surface layer to the inside. The fracture surfaces of single filaments were observed, and it was found that macro-defects accounted for 40% while micro-defects accounted for 60%. As for the chemical function contents of the obtained carbon fibers, O/C was 0.12 and N/C was 0.06.

The critical stress intensity factor $K_{IC}$ was 3.7 MPa·m$^{1/2}$, and the ratio R of the silicon content in the outer layer of each single filament to that in the inner layer was 510. The difference (RD) between inner and outer layers obtained by RAMAN was 0.038, and the difference (AY) between inner and outer layers obtained by AFM was 74.

Example 4

Precursor fibers were obtained as described in Example 1, except that the oil did not contain ammonium carbonate. The gum-up rate on the heating rollers for drying and densifying was 7 times higher that in Example 1, and it was necessary for stable spinning and drawing to remove the oil gels every 12 hours.

The obtained carbon fibers had a single filament diameter of 7.0 μm, bundle tensile strength of 550 N, carbon fiber strength of 6.3 GPa, modulus of 255 GPa and breaking elongation of 2.47%. The obtained carbon fibers were used to form a composite material, and its 0° tensile strength was measured and found to be 3.4 GPa.

Example 5

Carbon fibers were obtained as described in Example 1, except that a copolymer consisting of 97.5 mol % of acrylonitrile, 0.5 mol % of itaconic acid, 1 mol % of isobutyl methacrylate and 2 mol % of methyl acrylate was produced by solution polymerization, to obtain a spinning dope with a concentration of 20 wt %. The strength and elongation of the precursor fibers were 6.1 g/d and 8.1% respectively. The precursor fibers were carbonized in a heating oven of atmospheric pressure at 250° C. for 15 minutes and further at 270° C. for 15 minutes, and the oxygen content distribution in the depth direction of the stabilized fibers was measured by SIMS. It was found that the oxygen content in the inner layer of each single filament was $1/3.14$ of that in the outer layer.

The obtained carbon fibers had a single filament diameter of 7.0 μm, bundle tensile strength of 600 N, carbon fiber strength of 6.8 GPa, modulus of 265 GPa and breaking elongation of 2.57%. The obtained carbon fibers were used to form a composite material, and its 0° tensile strength was measured and found to be 3.55 GPa.

The critical stress intensity factor $K_{Ic}$ was 4.0 MPa·m$^{1/2}$ and the ratio (R) of the silicon content in the outer layer of each single filament to that in the inner layer was 590.

Example 6

Carbon fibers were obtained as described in Example 1, except that a copolymer consisting of 97.5 mol % of acrylonitrile, 0.5 mol % of methacrylic acid, 1 mol % of diethylaminoethyl methacrylate and 2 mol % of methyl acrylate was produced by solution polymerization using DMSO as a solvent, that after completion of polymerization, concentrated hydrochloric acid diluted to 10 times by DMSO was added so that the amount of hydrochloric acid might be 1.2 times (in molar ratio) the amount of diethylaminoethyl methacrylate, being followed by stirring to convert amino groups to hydrochloride, that the spinning dope had a concentration of 24 wt %, and that diethanolamine was used instead of ammonium carbonate in the oil.

The obtained carbon fibers had a single filament diameter of 7.0 μm, bundle tensile strength of 500 N, carbon fiber strength of 6.6 GPa, modulus of 260 GPa and breaking elongation of 2.54%. The obtained carbon fibers were used to form a composite material, and its 0° tensile strength was measured and found to be 3.45 GPa.

The critical stress intensity factor $K_{IC}$ was 3.4 MPa·m$^{1/2}$ and the ratio (R) of the silicon content in the outer layer of each single filament to that in the inner layer was 510.

Example 7

Carbon fibers were obtained as described in Example 1, except that fine particles of polystyrene crosslinked by divinylbenzene were used instead of the fine particles of polymethyl methacrylate crosslinked by divinylbenzene in the oil.

The obtained carbon fibers had a single filament diameter of 7.0 μm, bundle tensile strength of 540 N, carbon fiber strength of 6.7 GPa, modulus of 260 GPa and breaking elongation of 2.58%. The obtained carbon fibers were used to form a composite material, and its 0° tensile strength was measured and found to be 3.5 GPa.

Example 8

A copolymer consisting of 95.5 mol % of acrylonitrile, 0.5 mol % of itaconic acid, 0.5 mol % of 2-acrylamido-2-methylpropanesulfonic acid, 1.5 mol % of normal propyl methacrylate and 2 mol % of ethyl acrylate was produced by solution polymerization using DMSO as a solvent. The 2-acrylamido-2-methylpropanesulfonic acid was used after dissolving it in DMSO and adjusting the pH to 6.5 by 28 wt % ammonia water. The dope had a concentration of 20 wt %. The obtained spinning dope was controlled at 30° C., and spun using a spinneret with 6000 holes respectively with a diameter of 0.1 mm, once into air, to pass a space of about 3 mm. Then, they were introduced into 35 wt % DMSO aqueous solution controlled at 0° C., to be coagulated, and washed with water, being drawn to 3 times in hot water baths with 90° C. as the highest temperature. The swelling degrees of the coagulated fibers and bath-drawn fibers were 200 and 65 respectively. The bath-drawn fibers were sized with an oil formed by a mixture consisting of a silicone oil composed of an amino-modified silicone, epoxy-modified silicone and ethylene-modified silicone, fine particles (0.1 μm in particle size) of polymethyl methacrylate crosslinked by divinylbenzene, and ammonium hydrogencarbonate. The viscosities of the amino-modified silicone, epoxy-modified silicone and ethylene-modified silicone at 25° C. were 5000 cSt, 10000 cSt and 1000 cSt respectively. The mixing rates of the silicone oil, fine particles and ammonium carbonate were 89 wt %, 10 wt % and 1 wt % respectively.

Subsequently, water was applied by 30 wt % based on the weight of dry filaments, and the fibers were brought into contact with 10 zigzag arranged free rollers with a diameter of 30 mm, to have the oil uniformly sized, and brought into contact with a 150° C. drying drum, to be dried and densified, and after a moisture content of 1 wt % or less was achieved, they were further heat-treated in contact with a drum with a temperature of 180° C.

The obtained fibers were further drawn in pressure steam of $4.5\times10^5$ Pa to 4.5 times, and two strands were joined and wound, to obtain precursor fibers to be processed into carbon fibers, consisting of 12000 filaments respectively with a single filament fineness of 1 d.

The obtained precursor fibers were heat-treated in air at 240~270° C. at a drawing ratio of 0.90, to obtain stabilized fibers with a specific gravity of 1.30. They were further carbonized in nitrogen at a temperature rising rate of 400° C./min in a temperature range of 300 to 500° C. and at a temperature rising rate of 500° C./min in a temperature range of 1000 to 1200° C. up to 1300° C. at a drawing ratio of 0.92. After completion of carbonization, they were subjected to anode oxidation treatment of 10 C/g-CF in sulfuric acid aqueous solution.

The obtained carbon fibers had a single filament diameter of 7.0 μm, bundle tensile strength of 500 N, carbon fiber strength of 6.5 GPa, modulus of 235 GPa and breaking elongation of 2.77%. The obtained carbon fibers were used to form a composite material, and its 0° tensile strength was measured and found to be 3.3 GPa.

The critical stress intensity factor $K_{IC}$ was 3.3 $MPa\cdot m^{1/2}$ and the ratio (R) of the silicon content in the outer layer of each single filament to that in the inner layer was 630.

Example 9

Carbon fibers were obtained as described in Example 1, except that the highest temperature of the drawing baths was 70° C.

The obtained carbon fibers had a single filament diameter of 7.0 μm, bundle tensile strength of 560 N, carbon fiber strength of 6.2 GPa, modulus of 260 GPa and breaking elongation of 2.38%. The obtained carbon fibers were used to form a composite material, and its 0° tensile strength was measured and found to be 3.3 GPa.

The ratio (R) of the silicon content in the outer layer of each single filament to that in the inner layer was 290.

Example 10

Carbon fibers were obtained as described in Example 1, except that a copolymer consisting of 94.3 mol % of acrylonitrile, 0.7 mol % of methacrylic acid, 1 mol % of isobutyl methacrylate and 4 mol % of methyl acrylate was used.

The obtained carbon fibers had a single filament diameter of 7.0 μm, bundle tensile strength of 530 N, carbon fiber strength of 5.8 GPa, modulus of 250 GPa and breaking elongation of 2.32%. The obtained carbon fibers were used to form a composite material, and its 0° tensile strength was measured and found to be 3.0 GPa.

The critical stress intensity factor $K_{IC}$ was 3.8 $MPa\cdot m^{1/2}$ and the ratio (R) of the silicon content in the outer layer of each single filament to that in the inner layer was 540.

Example 11

Carbon fibers were obtained as described in Example 1, except that a silicone oil consisting of an amino-modified silicone and an epoxy-modified silicone was used.

The obtained carbon fibers had a single filament diameter of 7.0 μm, bundle tensile strength of 540 N, carbon fiber strength of 6.2 GPa, modulus of 255 GPa and breaking elongation of 2.43%. The obtained carbon fibers were used to form a composite material, and its 0° tensile strength was measured and found to be 3.2 GPa.

Example 12

Carbon fibers were obtained as described in Example 1, except that ethanolamine was used instead of ammonium carbonate.

The obtained carbon fibers had a single filament diameter of 7.0 μm, bundle tensile strength of 560 N, carbon fiber strength of 6.6 GPa, modulus of 260 GPa and breaking elongation of 2.54%. The obtained carbon fibers were used to form a composite material, and its 0° tensile strength was measured and found to be 3.4 GPa.

Example 13

Carbon fibers were obtained as described in Example 1, except that the mixing rates of the silicone oil, fine particles of crosslinked polymethyl methacrylate and ammonium carbonate were 70 parts by weight, 28 parts by weight and 2 parts by weight respectively.

The obtained carbon fibers had a single filament diameter of 7.0 μm, bundle tensile strength of 580 N, carbon fiber strength of 6.1 GPa, modulus of 260 GPa and breaking elongation of 2.35%. The obtained carbon fibers were used to form a composite material, and its 0° tensile strength was measured and found to be 3.1 GPa.

Example 14

Carbon fibers were obtained as described in Example 1, except that fine particles of polymethyl methacrylate-acrylonitrile copolymer crosslinked by divinylbenzene were used instead of the fine particles of polymethyl methacrylate crosslinked by divinylbenzene.

The obtained carbon fibers had a single filament diameter of 7.0 μm, bundle tensile strength of 570 N, carbon fiber strength of 6.4 GPa, modulus of 255 GPa and breaking elongation of 2.51%. The obtained carbon fibers were used to form a composite material, and its 0° tensile strength was measured and found to be 3.3 GPa.

Example 15

Carbon fibers were obtained as described in Example 1, except that a copolymer consisting of 95.5 mol % of acrylonitrile, 1 mol % of acrylamide, 1 mol % of isobutyl methacrylate, 2 mol % of methyl acrylate and 0.5 mol % of itaconic acid was used.

The obtained carbon fibers had a single filament diameter of 7.0 μm, bundle tensile strength of 530 N, carbon fiber strength of 6.7 GPa, modulus of 250 GPa and breaking elongation of 2.68%. The obtained carbon fibers were used to form a composite material, and its 0° tensile strength was measured and found to be 3.5 GPa.

The critical stress intensity factor $K_{IC}$ was 3.3 MPa·m$^{1/2}$ and the ratio (R) of the silicon content in the outer layer of each single filament to that in the inner layer was 610.

Example 16

Carbon fibers were obtained as described in Example 8, except that a copolymer consisting of 96.5 mol % of acrylonitrile, 0.5 mol % of itaconic acid, 0.5 mol % of isobutyl methacrylate and 2.5 mol % of methyl acrylate was used.

The obtained carbon fibers had a single filament diameter of 7.0 μm, bundle tensile strength of 590 N, carbon fiber strength of 6.7 GPa, modulus of 250 GPa and breaking elongation of 2.68%. The obtained carbon fibers were used to form a composite material, and its 0° tensile strength was measured and found to be 3.5 GPa.

The critical stress intensity factor $K_{IC}$ was 3.9 MPa·m$^{1/2}$ and the ratio (R) of the silicon content in the outer layer of each single filament to that in the inner layer was 600.

Example 17

Carbon fibers were obtained as described in Example 16, except that ammonium carbonate was not used.

The obtained carbon fibers had a single filament diameter of 7.0 μm, bundle tensile strength of 560 N, carbon fiber strength of 6.7 GPa, modulus of 260 GPa and breaking elongation of 2.58%. The obtained carbon fibers were used to form a composite material, and its 0° tensile strength was measured and found to be 3.5 GPa.

Example 18

Carbon fibers were obtained as described in Example 16, except that the fine particles of polymethyl methacrylate crosslinked by divinylbenzene were not used.

The obtained carbon fibers had a single filament diameter of 7.0 μm, bundle tensile strength of 500 N, carbon fiber strength of 6.4 GPa, modulus of 260 GPa and breaking elongation of 2.46%. The obtained carbon fibers were used to form a composite material, and its 0° tensile strength was measured and found to be 3.4 GPa.

Example 19

Carbon fibers were obtained as described in Example 16, except that fine particles of teflon were used instead of the fine particles of polymethyl methacrylate crosslinked by divinylbenzene. A very slight amount of hydrogen fluoride was evolved in the carbonization process.

The obtained carbon fibers had a single filament diameter of 7.0 μm, bundle tensile strength of 600 N, carbon fiber strength of 6.8 GPa, modulus of 265 GPa and breaking elongation of 2.57%. The obtained carbon fibers were used to form a composite material, and its 0° tensile strength was measured and found to be 3.5 GPa.

Comparative Example 1

Carbon fibers were obtained as described in Example 1, except that a copolymer consisting of 99.5 mol % of acrylonitrile (AN) and 0.5 mol % of methacrylic acid was used and that the highest temperature of the drawing baths was 50° C.

The obtained carbon fibers had a single filament diameter of 7.0 μm, carbon fiber strength of 5.2 GPa, modulus of 260 GPa and elongation of 2.00%. The obtained carbon fibers were used to form a composite material, and its 0 tensile strength was measured and found to be 2.65 GPa.

The cross sections of the obtained carbon fibers were observed by TEM, and a ring pattern was observed between the surface layer and the inside of each filament. The fracture surfaces of single filaments were observed, and it was found that macro-defects accounted for 65% while micro-defects accounted for 35%.

The obtained carbon fibers had a silicon content Si/C of 0.01. As for the chemical function contents, O/C was 0.15 and N/C was 0.06. The tensile strength of the carbon fiber bundles was 540 N.

The critical stress intensity factor $K_{IC}$ was 2.9 MPa·m$^{1/2}$, and the ratio (R) of the silicon content in the outer layer of each single filament to that in the inner layer was 90. The difference (RD) between inner and outer layers obtained by RAMAN was 0.06, and the difference (AY) between inner and outer layers obtained by AFM was 59.

Comparative Example 2

Carbon fibers were obtained as described in Example 1, except that dimethylsiloxane was used as the oil and that the highest temperature of the drawing baths was 50° C. The swelling degree of the bath-drawn fibers was 160%.

The obtained carbon fibers had a single filament diameter of 7.0 μm, bundle tensile strength of 200 N, carbon fiber strength of 2.6 GPa, modulus of 220 GPa and breaking elongation of 1.16%. The obtained carbon fibers were used to form a composite material, and its 0° tensile strength was measured and found to be 1.25 GPa.

Comparative Example 3

Carbon fibers were obtained as described in Example 1, except that a copolymer consisting of 96 mol % of acrylonitrile and 4 mol % of acrylic acid were used.

The obtained carbon fibers had a single filament diameter of 7.0 μm, bundle tensile strength of 550 N, carbon fiber strength of 4.8 GPa, modulus of 250 GPa and breaking elongation of 1.92%. The obtained carbon fibers were used to form a composite material, and its 0° tensile strength was measured and found to be 2.5 GPa.

The critical stress intensity factor $K_{IC}$ was 2.6 MPa·m$^{1/2}$, and the ratio (R) of the silicon content in the outer layer of each single filament to that in the inner layer was 590.

Comparative Example 4

Spinning was effected as described in Example 1, except that a copolymer consisting of 96 mol % of acrylonitrile, 1 mol % of itaconic acid and 3 mol % of isobutyl methacrylate was used. The drawability in pressure steam was low, and drawing to 13 times could not be achieved.

Comparative Example 5

Carbon fibers were obtained as described in Example 1, except that a copolymer consisting of 96 mol % of acrylonitrile, 1 mol % of itaconic acid and 3 mol % o methyl acrylate was used.

The obtained carbon fibers had a single filament diameter of 7.0 μm, bundle tensile strength of 550 N, carbon fiber strength of 5.3 GPa, modulus of 255 GPa and breaking elongation of 2.08%. The obtained carbon fibers were used to form a composite material, and its 0° tensile strength was measured and found to be 2.7 GPa.

The critical stress intensity factor $K_{IC}$ was 3.0 MPa·m$^{1/2}$, and the ratio (R) of the silicon content in the outer layer of each single filament to that in the inner layer was 570.

Comparative Example 6

Carbon fibers were obtained as described in Comparative Example 5, except that the fine particles of polymethyl methacrylate crosslinked by divinylbenzene and ammonium carbonate were not used.

The obtained carbon fibers had a single filament diameter of 7.0 μm, bundle tensile strength of 380 N, carbon fiber strength of 4.8 GPa, modulus of 250 GPa and breaking elongation of 1.92%. The obtained carbon fibers were used to form a composite material, and its 0° tensile strength was measured and found to be 2.45 GPa.

Comparative Example 7

Carbon fibers were obtained as described in Comparative Example 6, except that the single filaments had a fineness of 0.5 d.

The obtained carbon fibers had a single filament diameter of 4.9 μm, bundle tensile strength of 650 N, carbon fiber strength of 7.0 GPa, modulus of 285 GPa and breaking elongation of 2.46%. The obtained carbon fibers were used to form a composite material, and its 0° tensile strength was measured and found to be 3.65 GPa.

The critical stress intensity factor $K_{IC}$ was 3.3 MPa·m$^{1/2}$, and the ratio (R) of the silicon content in the outer layer of each single filament to that in the inner layer was 410.

Comparative Example 8

Carbon fibers were obtained as described in Example 1, except that a copolymer consisting of 99.5 mol % of acrylonitrile and 0.5 mol % of methacrylic acid was used, and that the spinning dope was controlled at 50° C. and spun using a spinneret with 6000 holes respectively with a diameter of 0.06 mm directly into a coagulating bath composed of 50% DMSO aqueous solution controlled at 50° C. for coagulation, according to the wet spinning method. The strength, elongation and ΔL of the precursor obtained intermediately were 5.9 g/d, 7.8% and 60 respectively.

The obtained carbon fibers had a single filament diameter of 7.0 μm, bundle tensile strength of 350 N, carbon fiber strength of 3.5 GPa, modulus of 235 GPa and breaking elongation of 1.49%. The obtained carbon fibers were used to form a composite material, and its 0° tensile strength was measured and found to be 1.8 GPa.

The critical stress intensity factor $K_{IC}$ was 2.9 MPa·m$^{1/2}$, and the ratio (R) of the silicon content in the outer layer of each single filament to that in the inner layer was 80.

Examples 20 and 21, and Comparative Example 9

A polymer dope with a [η] value of 1.70 and with a polymer content of 20 wt % consisting of 99 wt % of acrylonitrile and 1 wt % of itaconic acid was obtained by solution polymerization using dimethyl sulfoxide as a solvent, and ammonia was blown into the dope, to convert the carboxyl groups in the itaconic acid component into the ammonium salt, to obtain a spinning dope. It was spun through a spinneret with 3,000 holes respectively with a diameter of 0.12 mm once into air, to pass a space of about 3 mm, and coagulated in 10° C. 30 wt % dimethyl sulfoxide aqueous solution. The coagulated filaments were washed with water, drawn in a bath with a temperature of 70° C. to 3 times, sized with a process oil containing 2% of an amino-modified silicone with a kinetic viscosity of 1,000 cSt and a percentage shown in Table 3 of boric acid, and dried and densified. Furthermore, they were drawn to 4 times in pressure steam, to obtain precursor fibers with a single filament fineness of 1 denier and a total fineness of 3,000 deniers. The swelling degree of the bath-drawn fibers was 105%.

The obtained precursor fibers were heated in air of 240 to 280° C. at a drawing ratio of 0.90, to obtain stabilized fibers with a specific gravity of 1.32 g/cm$^3$. Then, they were heated in nitrogen atmosphere with the temperature raised at a rate of 200° C./min in a temperature range from 350 to 500° C., to be shrunken by 5%, and carbonized up to 1,300° C.

In succession, they were treated by electrolysis with 0.1 mol/l sulfuric acid aqueous solution as an electrolyte at 10 coulombs/g, washed with water and dried in air of 150° C. The physical properties of carbon fibers are shown in Table 3.

The carbon fibers of Comparative Example 9 had a crystal size Lc of 1.89 nm, orientation degree π002 of 80.0%, and small angle scattering intensity of 1,120 cps. Since the orientation degrees of the outer and inner layers obtained by TEM were respectively 83.3% and 63.0%, the ratio R of the orientation degree of the outer layer of each single filament to that of the inner layer obtained by TEM was 1.32.

Examples 22 to 25

Carbon fibers were obtained as described in Example 1, except that the bath drawing temperature was 90° C. and that a process oil consisting of the silicone oil shown in Table 4 and 0.5% of boric acid was applied. The swelling degree of the bath-drawn fibers was 85%. The physical properties of the obtained carbon fibers are shown in Table 4. The carbon fibers of Example 23 had a crystal size Lc of 1.77 nm, orientation degree π002 of 80.5% and small angle scattering intensity of 850 cps. The difference (RD) between the inner and outer layers obtained by RAMAN was 0.036, and the difference (AY) between the inner and outer layers obtained by AFM was 77. Since the orientation degrees of the outer and inner layers obtained by TEM were respectively 80.0% and 82.5%, the ratio R of the orientation degree of the outer layer of each single filament to that of the inner layer obtained by TEM was 0.97.

Example 26

A polymer dope with a [η] value of 1.70 and with a polymer content of 20 wt % consisting of 99 wt % of acrylonitrile and 1 wt % of itaconic acid was obtained by solution polymerization using dimethyl sulfoxide as a solvent, and ammonia was blown into the dope, to convert the carboxyl groups of the itaconic acid component into the ammonium salt, for obtaining a spinning dope. It was spun through a spinneret with 3,000 holes respectively with a diameter of 0.12 mm once into air, to pass a space of about 3 mm, and coagulated in 10° C. 30 wt % dimethyl sulfoxide aqueous solution. The obtained coagulated filaments were washed with water, drawn in a bath with a temperature of 90° C. to 3 times, and sized with a process oil containing 0.95% of an amino-modified silicone with a kinetic viscosity of 4,000 cSt, 0.95% of an epoxy-modified silicone with a kinetic viscosity of 1,200 cSt, 0.1% of an ethylene-modified silicone with a kinetic viscosity of 300 cSt and 0.5% of boric acid. The filaments not yet dried or densified were drawn to 4 times in pressure steam, and dried and densified, to obtain precursor fibers with a single filament fineness of 1 denier and a total fineness of 3,000 deniers.

The obtained precursor fibers were heated in air of 240 to 280° C. at a drawing ratio of 0.90, to obtain stabilized fibers with a specific gravity of 1.37 g/cm$^3$. Then, they were heated in nitrogen atmosphere with the temperature raised at a rate of 200° C./min in a temperature range from 350 to 500° C., to be shrunken by 5%, and carbonized up to 1,300° C.

In succession, they were treated by electrolysis with 0.1 mol/l sulfuric acid aqueous solution as an electrolyte at 10 coulombs/g, washed with water, and dried in 150° C. air. The physical properties of the obtained carbon fibers are shown in Table 5.

Examples 27 and 28

Carbon fibers were obtained as described in Example 23, except that the single filament fineness of precursor fibers was as shown in Table 6. The physical properties of the obtained carbon fibers are shown in Table 6.

TABLE 1

| | Copolymerized Component (wt %) | | | | |
|---|---|---|---|---|---|
| | Densifying Accelerator | Oxygen Permeation Promotor | Drawing Promotor | Stabilization Accelerator | [η] |
| Example 1 | MAA 0.7 | iBMA 1.0 | MEA 2.0 | (MAA 0.7) | 1.85 |
| Example 2 | AA 0.6 | nBMA 1.0 | EA 1.4 | (AA 0.6) | 1.85 |
| Example 3 | AA 1.0 | nBMA 1.0 | EA 2.0 | (AA 1.0) | 1.85 |
| Example 4 | MAA 0.7 | iBMA 1.0 | MEA 2.0 | (MAA 0.7) | 1.75 |
| Example 5 | IA 0.5 | iBMA 1.0 | MEA 2.0 | (IA 0.5) | 1.75 |
| Example 6 | MAA 0.5 | DAEMA 1.0 | MEA 2.0 | (MAA 0.5) | 1.70 |
| Example 7 | MAA 0.7 | iBMA 1.0 | MEA 2.0 | (MAA 0.7) | 1.70 |
| Example 8 | AMPS 0.5 | PMA 1.5 | EA 2.0 | IA 0.5 | 1.85 |
| Example 9 | MAA 0.7 | iBMA 1.0 | MEA 2.0 | (MAA 0.7) | 1.75 |
| Example 10 | MAA 0.7 | iBMA 1.0 | MEA 4.0 | (MAA 0.7) | 1.98 |
| Example 11 | MAA 0.7 | iBMA 1.0 | MEA 2.0 | (MAA 0.7) | 1.75 |
| Example 12 | MAA 0.7 | iBMA 1.0 | MEA 2.0 | (MAA 0.7) | 1.75 |
| Example 13 | MAA 0.7 | iBMA 1.0 | MEA 2.0 | (MAA 0.7) | 1.75 |
| Example 14 | MAA 0.7 | iBMA 1.0 | MEA 2.0 | (MAA 0.7) | 1.75 |
| Example 15 | AAm 1.0, IA 0.5 | iBMA 1.0 | MEA 2.0 | (IA 0.5) | 1.85 |
| Example 16 | IA 0.5 | iBMA 0.5 | MEA 2.5 | (IA 0.5) | 1.70 |
| Example 17 | IA 0.5 | iBMA 0.5 | MEA 2.5 | (IA 0.5) | 1.70 |
| Example 18 | IA 0.5 | iBMA 0.5 | MEA 2.5 | (IA 0.5) | 1.70 |
| Example 19 | IA 0.5 | iBMA 0.5 | MEA 2.5 | (IA 0.5) | 1.70 |
| C-Example 1 | MAA 0.5 | | | (MAA 0.5) | 1.70 |
| C-Example 2 | MAA 0.7 | iBMA 1.0 | MEA 2.0 | (MAA 0.7) | 1.70 |
| C-Example 3 | AA 4.0 | | | (AA 4.0) | 1.70 |
| C-Example 4 | IA 1.0 | iBMA 3.0 | | (IA 1.0) | 1.70 |
| C-Example 5 | IA 1.0 | | MEA 3.0 | (IA 1.0) | 1.70 |
| C-Example 6 | IA 1.0 | | MEA 3.0 | (IA 1.0) | 1.70 |
| C-Example 7 | IA 1.0 | | MEA 3.0 | (IA 1.0) | 1.70 |
| C-Example 8 | MAA 0.5 | | (MAA 0.5) | 1.70 | |

| | Polymer Concentration (%) | Bath Drawing Temperature (° C.) | Amino Viscosity (cSt) | Epoxy Viscosity (cSt) | EO Viscosity (cSt) |
|---|---|---|---|---|---|
| Example 1 | 22 | 90 | 15000 | 3500 | 500 |
| Example 2 | 18 | 90 | 15000 | 3500 | 500 |
| Example 3 | 18 | 90 | 15000 | 3500 | 500 |
| Example 4 | 22 | 90 | 15000 | 3500 | 500 |
| Example 5 | 20 | 90 | 15000 | 3500 | 500 |
| Example 6 | 22 | 90 | 15000 | 3500 | 500 |
| Example 7 | 22 | 90 | 15000 | 3500 | 500 |
| Example 8 | 20 | 90 | 5000 | 10000 | 1000 |
| Example 9 | 22 | 70 | 15000 | 3500 | 500 |
| Example 10 | 20 | 90 | 15000 | 3500 | 500 |
| Example 11 | 22 | 90 | 15000 | 3500 | Nil |
| Example 12 | 22 | 90 | 15000 | 3500 | 500 |
| Example 13 | 22 | 90 | 15000 | 3500 | 500 |
| Example 14 | 22 | 90 | 15000 | 3500 | 500 |
| Example 15 | 22 | 90 | 15000 | 3500 | 500 |
| Example 16 | 22 | 90 | 5000 | 10000 | 1000 |
| Example 17 | 22 | 90 | 5000 | 10000 | 1000 |
| Example 18 | 22 | 90 | 5000 | 10000 | 1000 |
| Example 19 | 22 | 90 | 5000 | 10000 | 1000 |
| C-Example 1 | 22 | 50 | 15000 | 3500 | 500 |
| C-Example 2 | 22 | 50 | Polydimethylsiloxane | | |
| C-Example 3 | 22 | 90 | 15000 | 3500 | 500 |
| C-Example 4 | 22 | 90 | 15000 | 3500 | 500 |
| C-Example 5 | 22 | 90 | 15000 | 3500 | 500 |
| C-Example 6 | 22 | 90 | 15000 | 3500 | 500 |
| C-Example 7 | 22 | 90 | 15000 | 3500 | 500 |
| C-Example 8 | 22 | 90 | 15000 | 3500 | 500 |

TABLE 1-continued

| | Fine Particles | Crosslinking Accelerator | Silicone/Fine Particles/Cross-linking Accelerator | Fine-ness (d) | ΔL | Specific Gravity |
|---|---|---|---|---|---|---|
| Example 1 | PMMA | A—C | 85/13/2 | 1.0 | 25 | 1.175 |
| Example 2 | PMMA | A—C | 85/13/2 | 1.0 | 40 | |
| Example 3 | PMMA | A—C | 85/13/2 | 1.0 | 35 | |
| Example 4 | PMMA | Nil | 85/13/0 | 1.0 | 35 | |
| Example 5 | PMMA | A—C | 85/13/2 | 1.0 | — | 1.175 |
| Example 6 | PMMA | DEA | 85/13/0 | 1.0 | 37 | 1.173 |
| Example 7 | PSty | A—C | 85/13/2 | 1.0 | — | |
| Example 8 | PMMA | A—C | 89/10/1 | 1.0 | 20 | |
| Example 9 | PMMA | A—C | 85/13/2 | 1.0 | 39 | |
| Example 10 | PMMA | A—C | 85/13/2 | 1.0 | 35 | |
| Example 11 | PMMA | A—C | 85/13/2 | 1.0 | 30 | |
| Example 12 | PMMA | Ethanolamine | 85/13/2 | 1.0 | 35 | |
| Example 13 | PMMA | A—C | 70/28/2 | 1.0 | 35 | |
| Example 14 | PMMA-AN | A—C | 85/13/2 | 1.0 | 35 | |
| Example 15 | PMMA | A—C | 86/13/2 | 1.0 | 28 | |
| Example 16 | PMMA | A—C | 89/10/1 | 1.0 | 40 | |
| Example 17 | PMMA | Nil | 89/10/1 | 1.0 | 40 | |
| Example 18 | Nil | A—C | 89/0/1 | 1.0 | 40 | |
| Example 19 | PTFE | A—C | 89/10/1 | 1.0 | 40 | |
| C-Example 1 | PMMA | A—C | 85/13/2 | 1.0 | 45 | 1.165 |
| C-Example 2 | PMMA | A—C | 85/13/2 | 1.0 | 48 | 1.168 |
| C-Example 3 | PMMA | A—C | 85/13/2 | 1.0 | 38 | |
| C-Example 4 | PMMA | A—C | 85/13/2 | 1.0 | — | |
| C-Example 5 | PMMA | A—C | 85/13/2 | 1.0 | 45 | 1.172 |
| C-Example 6 | Nil | Nil | 100/0/0 | 1.0 | 47 | |
| C-Example 7 | Nil | Nil | 100/0/0 | 0.5 | 48 | |
| C-Example 8 | PMMA | A—C | 85/13/2 | 1.0 | 60 | 1.158 |

[Note: "C-Example" means Comparative Example, and "A—C" means Ammonium Carbonate]

TABLE 2

| | Oxygen Content Ratio | Single Filament Diameter of CF (μ) | Sectional Area of CF ($\mu m^2$) | Strength (GPa) | Modulus (GPa) |
|---|---|---|---|---|---|
| Example 1 | 1/3.5 | 7.0 | 38.5 | 6.5 | 260 |
| Example 2 | — | 4.9 | 18.8 | 7.5 | 290 |
| Example 3 | — | 7.0 | 38.5 | 6.8 | 270 |
| Example 4 | — | 7.0 | 38.5 | 6.3 | 255 |
| Example 5 | 1/3.14 | 7.0 | 38.5 | 6.8 | 265 |
| Example 6 | — | 7.0 | 38.5 | 6.6 | 260 |
| Example 7 | — | 7.0 | 38.5 | 6.7 | 260 |
| Example 8 | — | 7.0 | 38.5 | 6.5 | 235 |
| Example 9 | — | 7.0 | 38.5 | 6.2 | 260 |
| Example 10 | — | 7.0 | 38.5 | 5.8 | 250 |
| Example 11 | — | 7.0 | 38.5 | 6.2 | 255 |
| Example 12 | — | 7.0 | 38.5 | 6.6 | 260 |
| Example 13 | — | 7.0 | 38.5 | 6.1 | 260 |
| Example 14 | — | 7.0 | 38.5 | 6.4 | 255 |
| Example 15 | — | 7.0 | 38.5 | 6.7 | 250 |
| Example 16 | — | 7.0 | 38.5 | 6.8 | 265 |
| Example 17 | — | 7.0 | 38.5 | 6.7 | 260 |
| Example 18 | — | 7.0 | 38.5 | 6.4 | 260 |
| Example 19 | — | 7.0 | 38.5 | 6.8 | 265 |
| C-Example 1 | — | 7.0 | 38.5 | 5.2 | 260 |
| C-Example 2 | — | 7.0 | 38.5 | 2.6 | 220 |
| C-Example 3 | — | 7.0 | 38.5 | 4.8 | 250 |
| C-Example 4 | — | — | — | — | — |
| C-Example 5 | — | 7.0 | 38.5 | 5.3 | 255 |
| C-Example 6 | — | 7.0 | 38.5 | 4.8 | 250 |
| C-Example 7 | — | 4.9 | 18.8 | 7.0 | 285 |
| C-Example 8 | — | 7.0 | 38.5 | 3.5 | 235 |

| | Elongation % | Tensile Strength of Bundle (N) | Strength of Composite Material (GPa) | Silicon Content (%) | Silicon Content Ratio |
|---|---|---|---|---|---|
| Example 1 | 2.25 | 560 | 3.5 | 0.08 | 550 |
| Example 2 | 2.58 | 710 | 3.95— | 480 | |
| Example 3 | 2.52 | 540 | 3.55 | 0.08 | 510 |

TABLE 2-continued

| | | | | | |
|---|---|---|---|---|---|
| Example 4 | 2.47 | 550 | 3.4 | — | — |
| Example 5 | 2.57 | 600 | 3.55 | — | 590 |
| Example 6 | 2.54 | 500 | 3.45 | — | 510 |
| Example 7 | 2.58 | 540 | 3.5 | — | — |
| Example 8 | 2.77 | 500 | 3.3 | — | 630 |
| Example 9 | 2.38 | 560 | 3.3 | — | 290 |
| Example 10 | 2.32 | 530 | 3.0 | — | 540 |
| Example 11 | 2.43 | 540 | 3.2 | — | — |
| Example 12 | 2.54 | 560 | 3.4 | — | — |
| Example 13 | 2.35 | 580 | 3.1 | — | — |
| Example 14 | 2.51 | 570 | 3.3 | — | — |
| Example 15 | 2.68 | 530 | 3.5 | — | 610 |
| Example 16 | 2.57 | 590 | 3.55 | — | 600 |
| Example 17 | 2.58 | 560 | 3.5 | — | — |
| Example 18 | 2.46 | 500 | 3.4 | — | — |
| Example 19 | 2.57 | 600 | 3.5 | — | — |
| C-Example 1 | 2.00 | 540 | 2.65 | 0.01 | 90 |
| C-Example 2 | 1.16 | 200 | 1.25 | — | — |
| C-Example 3 | 1.92 | 550 | 2.5 | — | 590 |
| C-Example 4 | — | — | — | — | — |
| C-Example 5 | 2.08 | 550 | 2.7 | — | 570 |
| C-Example 6 | 1.92 | 380 | 2.45 | — | — |
| C-Example 7 | 2.46 | 650 | 3.65 | — | 410 |
| C-Example 8 | 1.49 | 350 | 1.8 | — | 80 |

| | Ring Pattern | Percentage of Failure due to Macro-defects (%) | $K_{IC}$ (MPa · m½) |
|---|---|---|---|
| Example 1 | not observed | 45 | 3.6 |
| Example 2 | — | — | 3.7 |
| Example 3 | not observed | 40 | 3.7 |
| Example 4 | — | — | — |
| Example 5 | — | — | 4.0 |
| Example 6 | — | — | 3.4 |
| Example 7 | — | — | — |
| Example 8 | — | — | 3.3 |
| Example 9 | — | — | — |
| Example 10 | — | — | 3.8 |
| Example 11 | — | — | — |
| Example 12 | — | — | — |
| Example 13 | — | — | — |
| Example 14 | — | — | — |
| Example 15 | — | — | 3.3 |
| Example 16 | — | — | 3.9 |
| Example 17 | — | — | — |
| Example 18 | — | — | — |
| Example 19 | — | — | — |
| C-Example 1 | observed | 65 | 2.9 |
| C-Example 2 | — | — | — |
| C-Example 3 | — | — | 2.6 |
| C-Example 4 | — | — | — |
| C-Example 5 | — | — | 3.0 |
| C-Example 6 | — | — | — |
| C-Example 7 | — | — | 3.3 |
| C-Example 8 | — | — | 2.9 |

[Note: "C-Example means Comparative Example]

TABLE 3

| | Boric Acid Concentration | Content Ratio of Inner Layer to Outer Layer R | | Single Filament Diameter | Sectional Area of Single Filament |
|---|---|---|---|---|---|
| | (%) | Boron | Silicon | d(μm) | S(μm²) |
| C-Example 9 | 0 | — | 410 | 6.77 | 36.0 |
| Example 20 | 0.5 | 11 | 430 | 6.99 | 38.4 |
| Example 21 | 1.0 | 10 | 440 | 6.91 | 37.5 |

| | Strength (GPa) | Modulus (GPa) | Breaking Elongation (%) | Tensile Strength of Bundle (N) | $K_{IC}$ (MPa · m½) | Percentage of Macro-defects (%) |
|---|---|---|---|---|---|---|
| C-Example 9 | 4.98 | 238 | 2.09 | 530 | 2.9 | 61 |
| Example 20 | 5.93 | 244 | 2.43 | 559 | 3.7 | 46 |

TABLE 3-continued

| | | | | | | |
|---|---|---|---|---|---|---|
| Example 21 | 5.72 | 245 | 2.34 | 500 | 3.6 | 49 |

[Note: "C-Example" means Comparative Example]

TABLE 4

| | Amino-modified Silicone | | Epoxy-modified Silicone | | Ethylene-modified Silicone |
|---|---|---|---|---|---|
| | 1000 cSt | 4000 cSt | 6000 cSt | 12000 cSt | 300 cSt |
| Example 22 | 0.95 | 0 | 0.95 | 0 | 0.1 |
| Example 23 | 0 | 0.95 | 0 | 0.95 | 0.1 |
| Example 24 | 0.8 | 0 | 0.8 | 0 | 0.4 |
| Example 25 | 0 | 0.8 | 0 | 0.8 | 0.4 |

| | Single Filament Diameter d(μm) | Sectional Area of Single Filament S(μm$^2$) | Strength (GPa) | Modulus (GPa) |
|---|---|---|---|---|
| Example 22 | 6.92 | 37.8 | 6.09 | 245 |
| Example 23 | 6.90 | 37.4 | 6.45 | 247 |
| Example 24 | 6.85 | 36.9 | 6.01 | 242 |
| Example 25 | 6.87 | 37.1 | 6.29 | 244 |

| | Breaking Elongation (%) | Tensile Strength of Bundle (N) | $K_{IC}$ (MPa · m½) | Percentage of Macro-defects (%) |
|---|---|---|---|---|
| Example 22 | 2.49 | 570 | 3.8 | 48 |
| Example 23 | 2.61 | 598 | 3.8 | 40 |
| Example 24 | 2.48 | 550 | 3.7 | 46 |
| Example 25 | 2.58 | 567 | 3.8 | 43 |

TABLE 5

| | Content Ratio of Inner Layer to Outer Layer R | | Single Filament Diameter | Sectional Area of Single Filament | Strength | Modulus |
|---|---|---|---|---|---|---|
| | Boron | Silicon | d(μm) | S(μm$^2$) | (GPa) | (GPa) |
| Example 26 | 6 | 230 | 6.89 | 37.3 | 6.53 | 246 |

| | Breaking Elongation (%) | Tensile Strength of Bundle (N) | $K_{IC}$ (MPa · m½) | Percentage of Macro-defects (%) |
|---|---|---|---|---|
| Example 26 | 2.65 | 608 | 3.9 | 41 |

TABLE 6

| | Single Filament Fineness | Content Ratio of Inner Layer to Outer Layer R | | Single Filament Diameter | Sectional Area of Single Filament |
|---|---|---|---|---|---|
| | (deniers) | Boron | Silicon | d(μm) | S(μm$^2$) |
| Example 27 | 1.2 | 15 | 520 | 7.56 | 44.9 |
| Example 28 | 1.5 | 17 | 630 | 8.45 | 56.1 |

TABLE 6-continued

| | Strength (GPa) | Modulus (GPa) | Breaking Elongation (%) | Strength of Bundle (N) | $K_{IC}$ (MPa · m½) |
|---|---|---|---|---|---|
| Example 27 | 6.00 | 235 | 2.55 | 561 | 3.7 |
| Example 28 | 5.45 | 225 | 2.42 | 539 | 3.5 |

| | Percentage of | Difference between Inner | Difference between Inner and Outer |
|---|---|---|---|
| | | Tensile | |

TABLE 6-continued

| | Macro-defects (%) | and Outer Layers RD | Layers AY |
|---|---|---|---|
| Example 27 | 45 | 0.048 | 70 |
| Example 28 | 47 | 0.050 | 66 |

INDUSTRIAL APPLICABILITY

The object of the present invention is to provide carbon fibers with high tensile strength as a resin impregnated strand even if the single filaments constituting the carbon fibers are thick. The carbon fibers of the present invention consisting of a plurality of single filaments are characterized by satisfying the following relation:

$$\sigma \geqq 11.1-0.75d$$

where σ is the tensile strength of said carbon fibers as a resin impregnated strand (in GPa) and d is the average diameter of said single filaments (in μm).

The carbon fibers can be preferably used as a material for forming energy-related apparatuses such as CNG tanks, fly wheels, wind mills and turbine blades, a material for reinforcing structural members of roads, bridge piers, etc., and also a material for forming or reinforcing architectural members such as timber and curtain walls.

What is claimed is:

1. A process for producing carbon fibers, comprising the steps of:

(a) spinning an acrylic polymer consisting essentially of 90 mol % or more of acrylonitrile, densifying accelerator, drawing promoter, stabilization accelerator and oxygen permeation promoter thereby forming acrylic fibers of single filaments;

(b) drawing said acrylic fibers in water of 60° C. or higher without allowing the swelling degree of said single filaments of said acrylic fibers to exceed 100%; and (c) stabilizing and subsequently carbonizing said acrylic fibers.

2. A process for producing carbon fibers, according to claim 1, wherein the temperature of the oxidizing atmosphere for stabilization is 200° C. to 300° C. and the temperature of the inert atmosphere for carbonization is 1,100° C. to 2,000° C.

* * * * *

UNITED STATES PATENT AND TRADEMARK OFFICE

CERTIFICATE OF CORRECTION

PATENT NO. : 6,103,211

DATED : August 15, 2000

INVENTOR(S) : Matsuhisa, et al.

It is certified that error appears in the above-identified patent and that said Letters Patent is hereby corrected as shown below:

In column 2, at line 48, please delete "of".

In column 3, at line, 34, please insert --,-- after "acrylonitrile"; and at line 39, please insert --,-- after "strand".

In column 6, at line 4, please change "RD$\geq$0.05" to --RD$\leq$0.05--.

In column 52, at Table 1, at C-Example 8, at the subheading "Drawing Promotor", please delete "(MAA 0.5)"; at the subheading "Stabilization Accelerator", please insert --(MAA 0.5)--; and at the subheading "[n]", please insert --1.70--.

In column 53,, at Table 2, at Example 2, at the subheading "Silicon Content (%)", please delete "480", and at the subheading "Silicon Content Ratio", please insert --480--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*